US005495945A

United States Patent [19]

Apps et al.

[11] Patent Number: 5,495,945

[45] **Date of Patent: *Mar. 5, 1996**

[54] LOW DEPTH NESTABLE TRAY FOR BOTTLES OR THE LIKE

[75] Inventors: William P. Apps, Anaheim; Jonathan A. Kalin, Manhattan Beach, both of Calif.

[73] Assignee: Rehrig Pacific Company, Inc., Los Angeles, Calif.

[ * ] Notice: The term of this patent shall not extend beyond the expiration date of Pat. No. 5,445,273.

[21] Appl. No.: 133,375

[22] Filed: Oct. 8, 1993

Related U.S. Application Data

[63] Continuation-in-part of Ser. No. 25,746, Mar. 3, 1993, Pat. No. 5,445,273, which is a continuation-in-part of Ser. No. 963,678, Oct. 20, 1992, Pat. No. 5,305,884, and a continuation-in-part of Ser. No. 9,358, Jun. 11, 1993, Pat. No. Des. 356,211, and a continuation-in-part of Ser. No. 9,359, Jun. 11, 1993, Pat. No. Des. 356,679.

[51] Int. Cl.[6] ..... B65D 21/02

[52] U.S. Cl. ..... 206/519; 220/513; 220/516

[58] Field of Search ..... 206/505, 509, 206/511, 512; 220/513, 516

[56] References Cited

U.S. PATENT DOCUMENTS

| | | | |
|---|---|---|---|
| D. 317,670 | 6/1991 | Apps . | |
| D. 318,552 | 7/1991 | Apps . | |
| 2,960,134 | 11/1960 | Fornas | 206/509 |
| 3,270,913 | 9/1966 | Bridenstine et al. . | |
| 3,638,827 | 2/1972 | Lau, Jr. et al. | 206/512 |
| 3,642,168 | 2/1972 | Wiley, Jr. et al. . | |
| 3,734,341 | 5/1973 | Levenhagen . | |
| 3,791,549 | 2/1974 | Delbrouck | 206/509 |
| 4,027,796 | 6/1977 | Martin . | |
| 4,410,099 | 10/1983 | deLarosiere . | |
| 4,416,374 | 11/1983 | Smith et al. . | |
| 4,478,344 | 10/1984 | Rehrig | 206/505 |
| 4,615,443 | 10/1986 | Deffner et al. . | |
| 4,899,874 | 2/1990 | Apps et al. . | |
| 4,928,841 | 5/1990 | Arthurs . | |
| 4,932,532 | 6/1990 | Apps et al. . | |
| 4,978,002 | 12/1990 | Apps et al. . | |
| 5,038,961 | 8/1991 | Watanabe et al. . | |
| 5,115,937 | 5/1992 | Chausse et al. . | |
| 5,163,587 | 11/1992 | Apps et al. . | |
| 5,323,925 | 6/1994 | Apps | 206/505 |

FOREIGN PATENT DOCUMENTS

| | | | |
|---|---|---|---|
| 1030944 | 5/1966 | United Kingdom | 206/505 |
| 2104047 | 3/1983 | United Kingdom | 206/505 |
| 2220196 | 4/1990 | United Kingdom . | |
| WO90/15758 | 12/1990 | WIPO . | |

OTHER PUBLICATIONS

Article entitled "Containers for Special Needs," published Jan. 1983 (p. 28).

Photographs of Husky Lite Crate, one perspective view and a top view (date unknown).

*Primary Examiner*—David Scherbel
*Assistant Examiner*—Randall E. Chin
*Attorney, Agent, or Firm*—Banner & Allegretti, Ltd.

[57] ABSTRACT

A low-depth nestable tray for bottles which is deeply nestable with similar empty trays and is stackable or cross-stackable with similar loaded trays. The tray floor configured to receive the tops of bottles in a loaded tray therebeneath to stably support a stack of loaded trays. The tray wall structure includes nesting rib assemblies which comprise inwardly projecting, upwardly disposed nesting ledge and an outwardly projecting, downwardly disposed rib. The ledges and ribs positioned and configured relative to one another such that when the tray is nested a distance down into a similar empty tray the rib rests on the corresponding shelf or ledge of the similar empty tray, so that the load of nested trays is transmitted vertically downward and fraying of the tray wall structure is prevented.

18 Claims, 19 Drawing Sheets

LOW DEPTH NESTABLE TRAY FOR BOTTLES OR THE LIKE

REFERENCE TO RELATED APPLICATIONS

This application is a continuation-in-part of application Ser. No. 08/025,746 filed Mar. 3, 1993, now U.S. Pat. No. 5,445,273 which is a continuation-in-part of application Ser. No. 07/963,678 filed Oct. 20, 1992, Now. U.S. Pat. No. 5,305,884 the entire contents of which are hereby incorporated by reference. The present application is also a continuation-in-part of design patent applications Ser. Nos. 29/009,358, now U.S. Pat. No. D356,211 and 29/009,359 now U.S. Pat. No. D356,679 both filed Jun. 11, 1993.

BACKGROUND OF THE INVENTION

The present invention relates to a low depth, nestable tray for transporting and storing containers, more particularly, the present invention relates trays that combine low depth with high stability for PET plastic bottles having a one liter capacity.

Bottles, particularly for soft drinks and other beverages, are often stored and transported during the distribution stages thereof in crates or trays. The term "crate" or "tray" as used herein includes crates, trays and similar containers having a bottom and peripheral sidewalls. These crates generally are configured to be stacked on top of each other when loaded with bottles. The crates also are configured to be nested together when empty of bottles. The plastic crates provide advantages such as conservation of storage space and efficient, easy handling and recyclability. In order to minimize the storage space of the crates when nested and to reduce cost and weight, many crates today are made with a shallow peripheral wall. These generally are referred to as "low depth" crates. Crates having a higher peripheral wall generally are referred to as "full depth" crates.

The sidewalls and internal supports and dividers of a full depth crate extend higher on the bottles within the crate and thus generally provide improved support for the bottle. However, the nested heights of empty, stacked full depth crates is greater than that of low depth crates. Low depth crates also are generally less expensive and lighter in weight than similarly constructed full depth crates. Thus, low depth crates are used extensively.

Low depth bottle crates for PET plastic bottles of one, two or three liter capacity have generally been designed for bottles having a straight-cylindrical body with tapering tops. An example of a known bottle crate is disclosed in commonly assigned U.S. Pat. No. 4,978,002 to Apps, et al, the disclosure of which is hereby incorporated by reference in its entirety.

Containers placed in low depth cases extend above the side walls. Thus, containers in a lower case must be able to support the weight of the other cases stacked on top of them.

Plastic bottles are widely used as containers for retailing soft drinks and other beverages. One type of plastic, polyethylene terephthalate (PET), has become particularly popular because of its transparency, light weight, and low cost. In addition to being flexible, the walls of PET bottles are strong in tension and thus can safely contain the pressure of a carbonated beverage. Moreover, conventional PET bottles can bear surprisingly high compressive loads, provided that the load is directed substantially along an axis symmetric or in line with the longitudinal axis of the bottle. A single PET bottle can support the weight of many bottles of the same size filled with fluid if the bottle is standing upright on a flat, horizontal surface and the weight of the other bottles is applied to the closure of the single bottle and is directed substantially vertically along the symmetric axis. However, if a compressive load is applied to a conventional PET beverage bottle along a direction other than the longitudinal axis of the bottle, the bottle tends to buckle. Thus, a crate intended to be stacked must ensure that the compressive load is directed substantially vertically along the longitudinal axes of the bottles.

PET bottles are ordinarily packed by bottlers in cases or other containers, several bottles to the case, for shipment to retailers or for storage. Cases of bottles are customarily stacked on top of each other. One way of handling the cases of bottles is to stacked the cases on pallets which can be lifted and moved about by fork-lift trucks. A technique for interconnecting columns of cases, is called cross-stacking, and is often used to improve stability of a stack of cases, or for display purposes by the retailer. There has been a need for bottle cases having structural features which facilitate stacking and cross-stacking of loaded cases, and enhance stability of columns of such cases.

One of the problems experienced with previous nestable trays is the absence of structural features which ensure that the loaded bottles will be maintained in a substantially vertically upright position to most advantageously bear the compressive load of bottles stacked thereabove while avoiding the possibility of buckling or other failures due to non-axial compressive loads. The present invention provides structural features to ensure that the bottles are maintained in a vertically upright position with minimal movement and jostling during handling of stacked and cross-stacked trays.

Other problems experienced with previous nestable trays include spreading or fraying of the side walls and "shingling" between trays placed in close side-by-side or end-to-end relation. The spreading or fraying problem often compounds the "shingling" problem. The present invention addresses both of these frequent complaints of previous trays. Structural supports to prevent spreading or fraying of the side walls are provided, which in turn help alleviate the "shingling" problem. Moreover, the side walls of the present tray are provided with additional structural improvements to avoid "shingling."

As to "shingling," previous nestable trays, which have nesting tabs or ribs on the exterior of the side walls, often are not easily handled because the tabs or ribs on the exterior of the side walls provide a catch surface between trays which come into contact. When stacks of trays are placed in close side-by-side and end-to-end relation, any catch surface such as a rib or tab on the exterior of the band will tend to land and rest on the upper edge or rim of the band of a neighboring tray. This overlapping of adjacent trays causes one end of the tray to be raised with respect to the other and is commonly referred to as "shingling". Shingling is disruptive of load stability on a pallet since it initially prevents the achievement of a perfectly squared load. Stacks which are unstable because of shingling are undesirable and can be a hazard. There exists a need for a nestable tray which is constructed to avoid shingling.

Spreading or fraying of side wall structures from nesting is a problem encountered with previous nestable trays. When a large number of trays are nested, the side walls of the trays near the bottom of the nested stack, which bear more of the load, have a tendency to spread or splay outward because no structural provision has been made for supporting the weight of trays nested above. This damage has a cumulative effect and results in a shorter service life for the trays, and thus additional expense for replacement. The shingling problem can be compounded in trays having no provision to prevent spreading or fraying. Any nesting tabs or ribs on the exterior of the side walls are even more prone to shingling or catching on other trays as the side walls spread outward. There has been a need for trays which maintain their structural integrity over repeated uses in both nested and loaded configurations. The present invention addresses the spreading problem by providing structural features to support the weight of stacked and nested trays. Since shingling is often compounded by spreading, this improvement alone would greatly alleviate the shingling problem. Moreover, as discussed above, the present tray also provides structural features on the outside of the side walls to prevent shingling.

SUMMARY OF THE INVENTION

Accordingly, it is a principal object of the present invention to provide a low depth tray which is nestable with other similar trays when empty to conserve space, and which is stackable and cross-stackable with other similar trays when loaded with containers for storing, displaying and transporting the containers. The tray of the present invention includes features for nesting empty trays and for stably stacking and cross-stacking loaded trays.

Another object of the present invention is to provide a low depth, nestable tray which has structural features to maintain containers in stacked trays in a vertical position to ensure that the containers bear the compressive load of the trays thereabove in a substantially vertical direction and prevent non-axial load failure.

Another object of the present invention is to provide a low depth, nestable tray which has sufficient structural features to prevent the side walls of the tray from spreading or fraying due to the weight of trays nested above it.

Still another object of the present invention is to provide a low depth, nestable tray which avoids shingling or catching on other trays during handling.

A still further object of the present invention is to provide a low depth nestable tray which makes efficient use of space both when loaded and stacked and when empty and nested.

Directed to achieving these objects, a new low depth, nestable tray for bottles is herein provided. The preferred configuration is for PET bottles of one liter capacity. This tray is formed by integrally molding from plastic, three basic components—a floor, a band and a plurality of columns interconnecting the band and floor.

The floor preferably has an open lattice design which not only allows unwanted fluids to drain out of the tray, but also requires less material and thus is lighter than a solid floor design. The floor also has container support areas, preferably in a three by four array.

The floor of the tray has an outer or bottom surface which is configured for accommodating the tops of bottles in a similar tray underneath. The floor bottom surface preferably has upwardly recessed receiving areas placed to surround the tops of bottles contained in a similar tray therebeneath. The receiving areas aid in retaining the bottles in vertically upright positions which enhances the ability of the bottles to bear the compressive load of bottles stacked thereabove. The receiving areas also prevent a tray from sliding along the tops of bottles in a tray underneath it.

The band is preferably of double wall construction and is substantially upright and extends around the periphery of the tray forming a wall structure. The band is positioned above the floor so as to be below the tops of the containers when the containers are positioned on the floor of the tray. However, the low depth arrangement is high enough relative to the containers to prevent them from tipping. The double wall construction is preferable for its strength and rigidity, especially if the tray is sized for one-liter bottles since a loaded tray would be relatively heavy. The exterior wall of the band is connected to the interior wall by bridging struts, some of which have anti-shingling extensions. The extensions are shaped inward and downward to act as camming surfaces so that no part of the tray can catch or shingle on another tray.

The columns extend between and interconnect the floor with the band. They are spaced around the periphery of the floor between adjacent support areas. The areas between the adjacent columns and between the band and floor along the sides are open, providing a light weight design allowing for visualization and display of the containers held in the tray. An important aspect of column height is that it is designed to hold the band far enough above the floor of the tray to enable a UPC code on a can or bottle contained in the tray to be read through the space between the columns.

At least one column along each side wall is preferably a ledged column. A ledged column has an interior wall rib extending vertically upward and inward from the floor of the tray and a vertical wall slot indented into the column above the interior wall rib. The top surface of the interior wall rib and the bottom surface of the wall slot form a wall nesting ledge. The nesting ledge acts as structural support for trays nested above it. To enhance the strength of the nesting ledge, the exterior of the ledged column includes an exterior wall rib extending vertically downward and outward opposite the interior wall rib. The bottom of the exterior wall rib is substantially flush with the floor bottom surface.

Each corner of the tray preferably has a corner column or post. Each corner post has an interior corner rib extending vertically upward and inward from the floor of the tray and a vertical corner slot indented into the corner post above the interior corner rib. The top surface of the interior corner rib and the bottom surface of the corner slot form a corner nesting ledge or shelf. The nesting ledge acts as structural support for trays nested above it. To enhance the strength of the nesting ledge, the exterior of the corner post includes an exterior corner rib extending vertically downward and outward opposite the interior corner rib. The bottom of the exterior corner rib is substantially flush with the floor bottom surface.

The corner slots and wall slots also serve to matingly engage the exterior corner ribs and exterior wall ribs respectively, of another tray nested thereabove.

The corner nesting ledges and wall nesting ledges are of the same height so that the weight of any trays nested thereabove would be distributed among the various nesting ledges. Preferably a tray of the present invention has a corner nesting ledge construction at each corner of the tray, and a wall nesting ledge construction on each of the longer side walls. In this way, the weight of nested trays above will be generally evenly distributed to the six nesting ledges.

These and other features and advantages of the invention may be more completely understood from the following detailed description of the preferred embodiments of the invention with reference to the accompanying drawings.

DETAILED DESCRIPTION OF THE PREFERRED EMBODIMENTS

The present invention is a low-depth tray which has structural features to facilitate nesting of empty trays and stable stacking and cross-stacking of loaded trays. The present invention is especially adaptable for one liter PET bottles.

Figure 7:
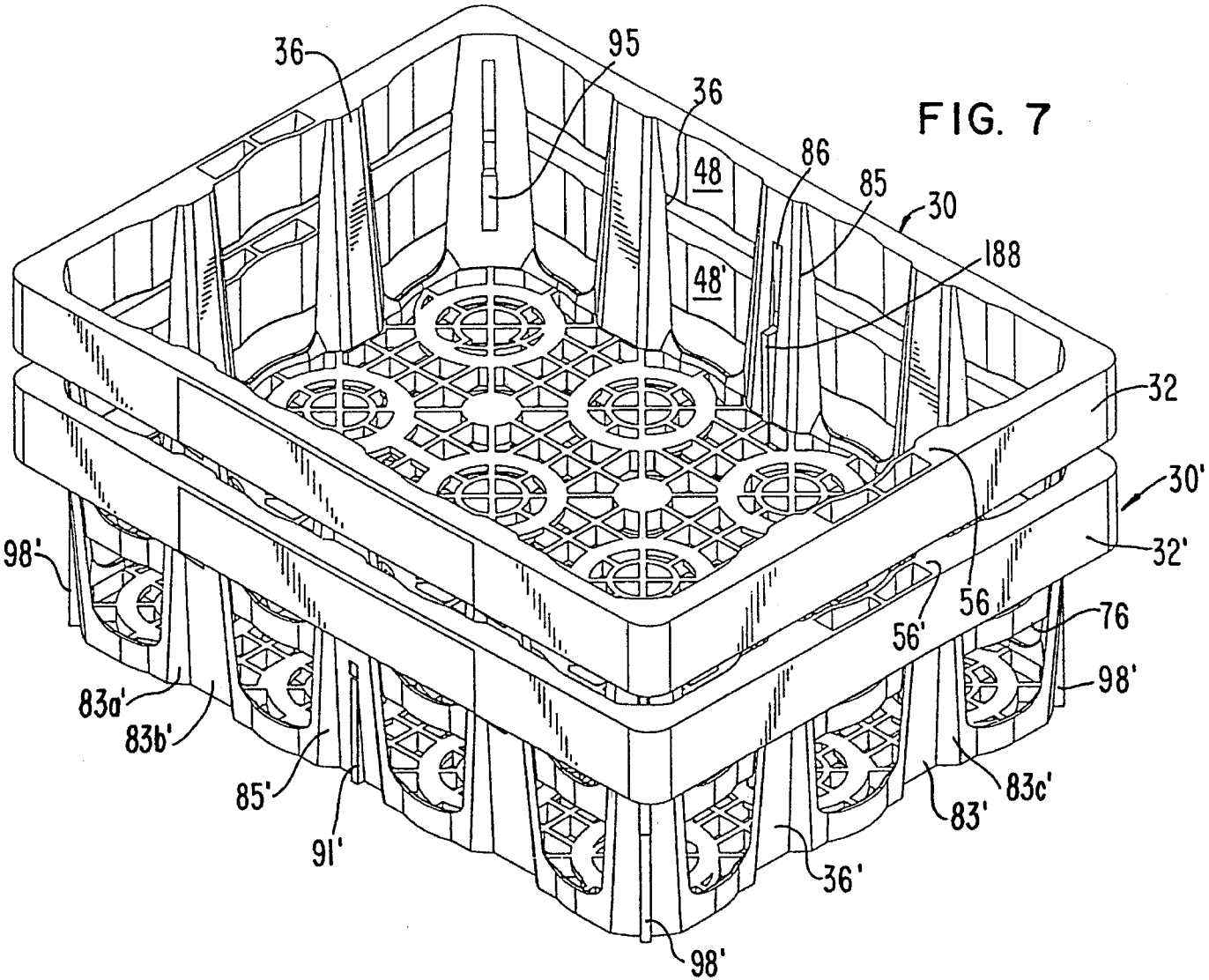
FIG. 7 is a top perspective view of the tray of FIG. 1 nested with an identical empty tray.
Figure 8:
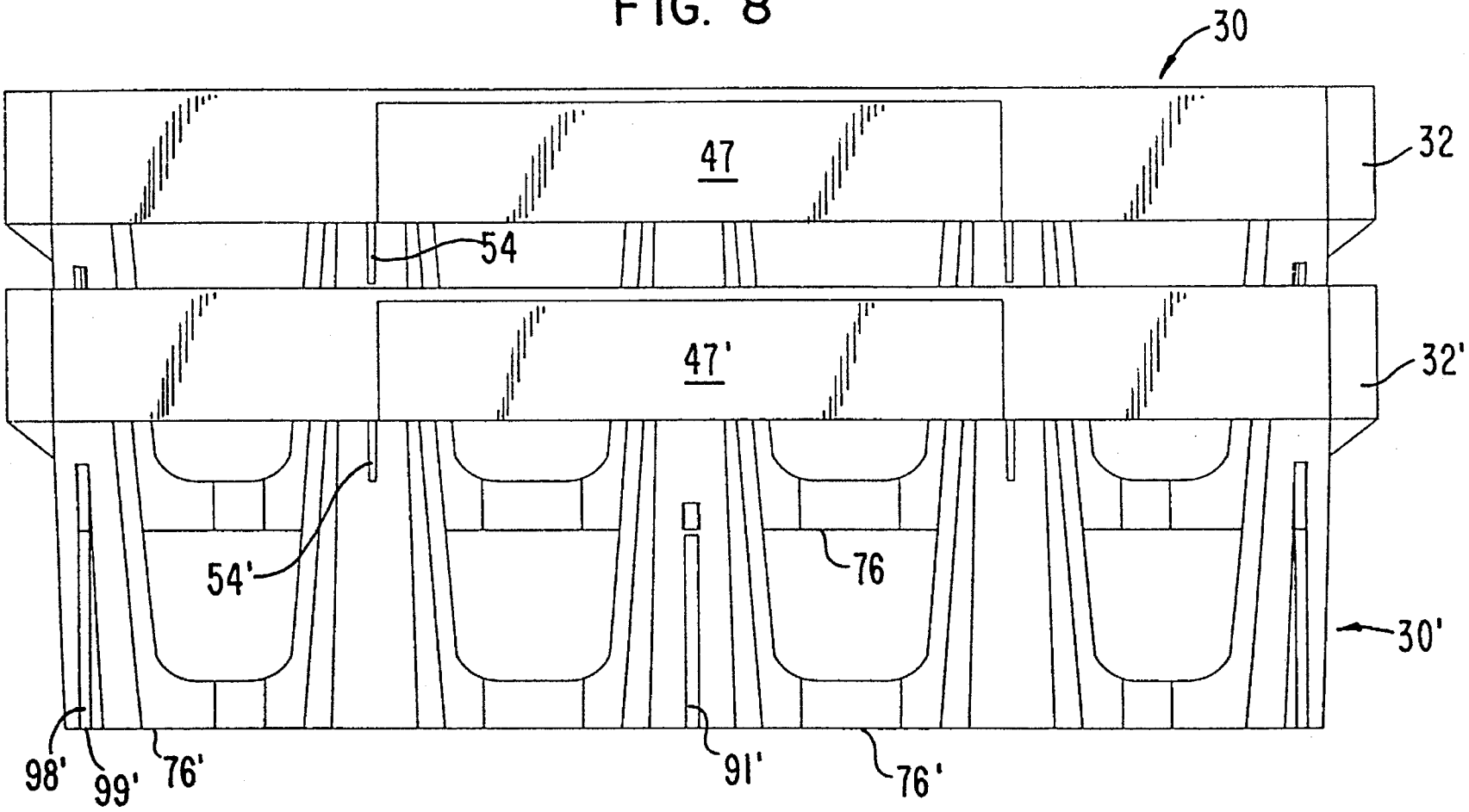
FIG. 8 is a side elevational view of the sidewalls of the nested trays of FIG. 7.
Figure 9:
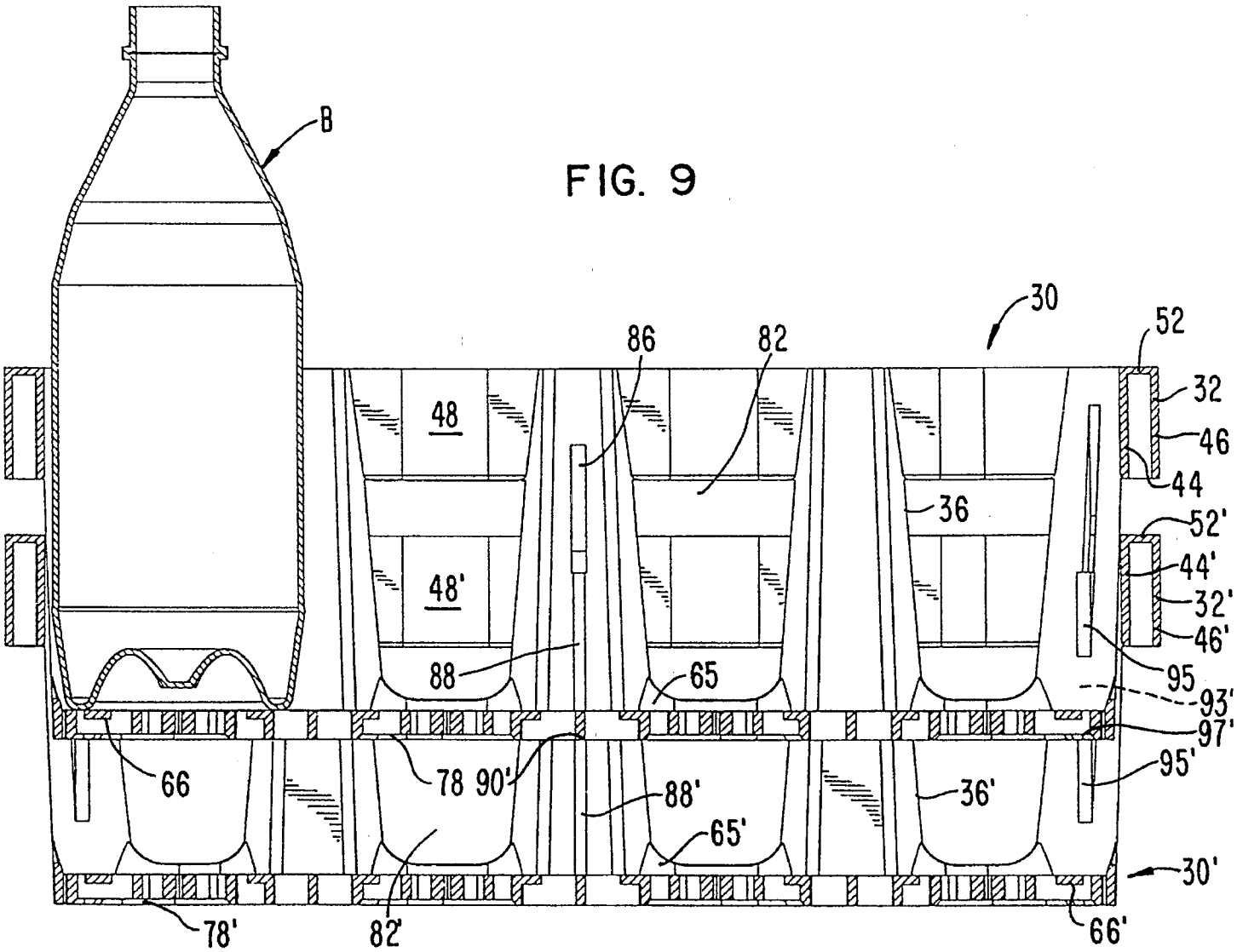
FIG. 9 is a cross-section of the nested trays taken along line 9—9 in FIG. 3 with a bottle on a peripheral receiving area.
Figure 10:
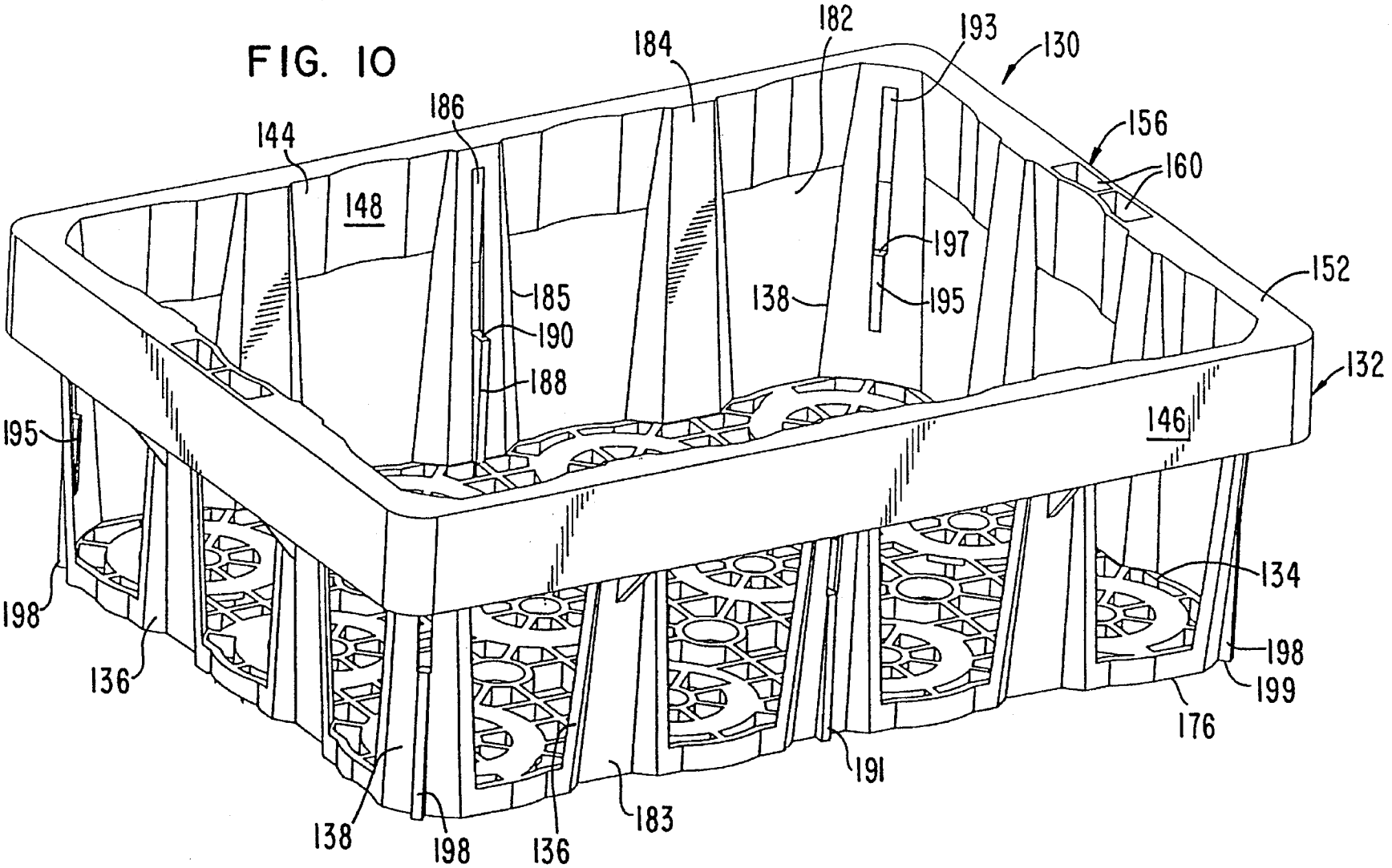
FIG. 10 is a top perspective view of a second preferred embodiment of the tray in accordance with the present invention.
Figure 11:
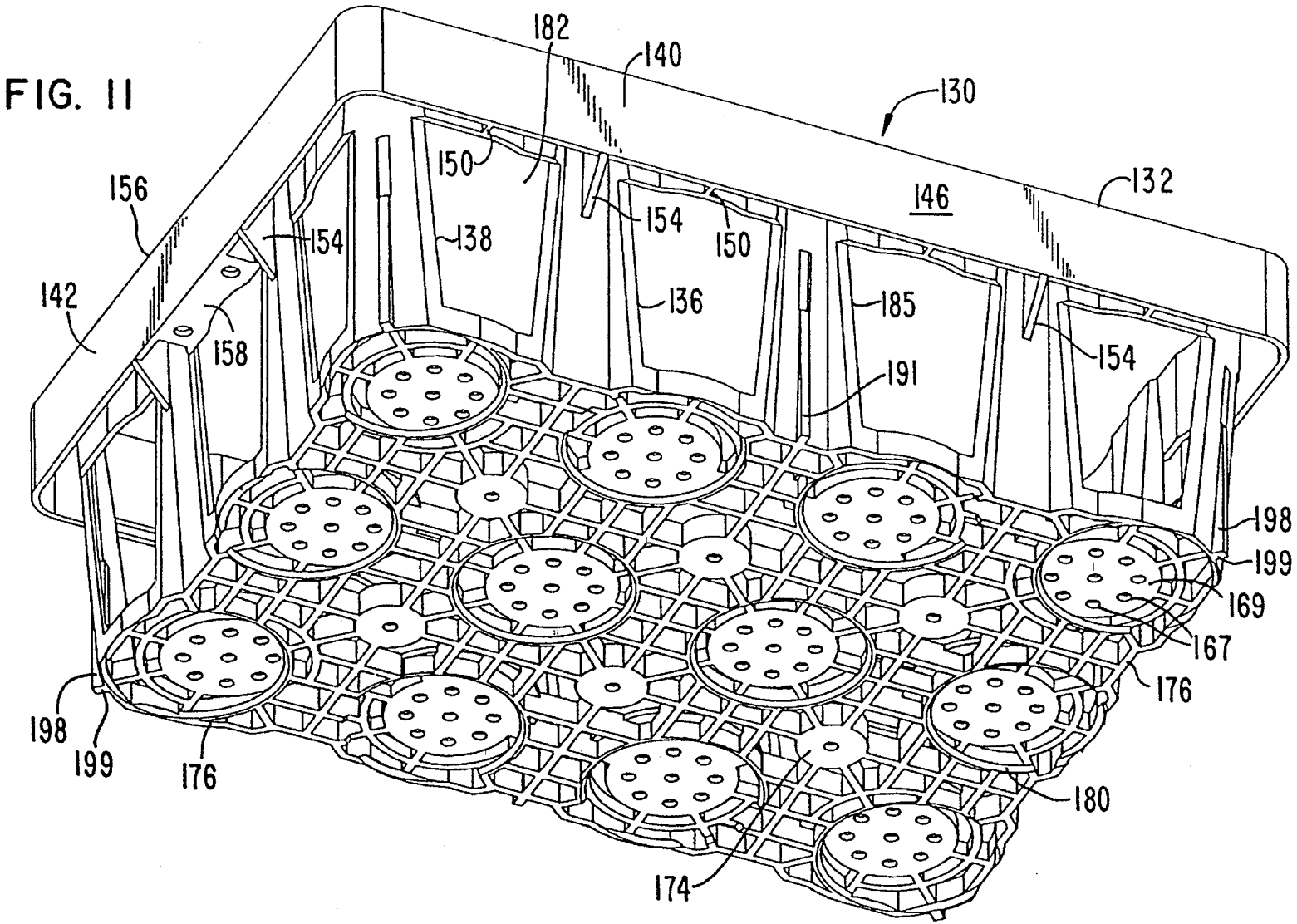
FIG. 11 is a bottom perspective view of the tray of FIG. 10.
Figure 12:
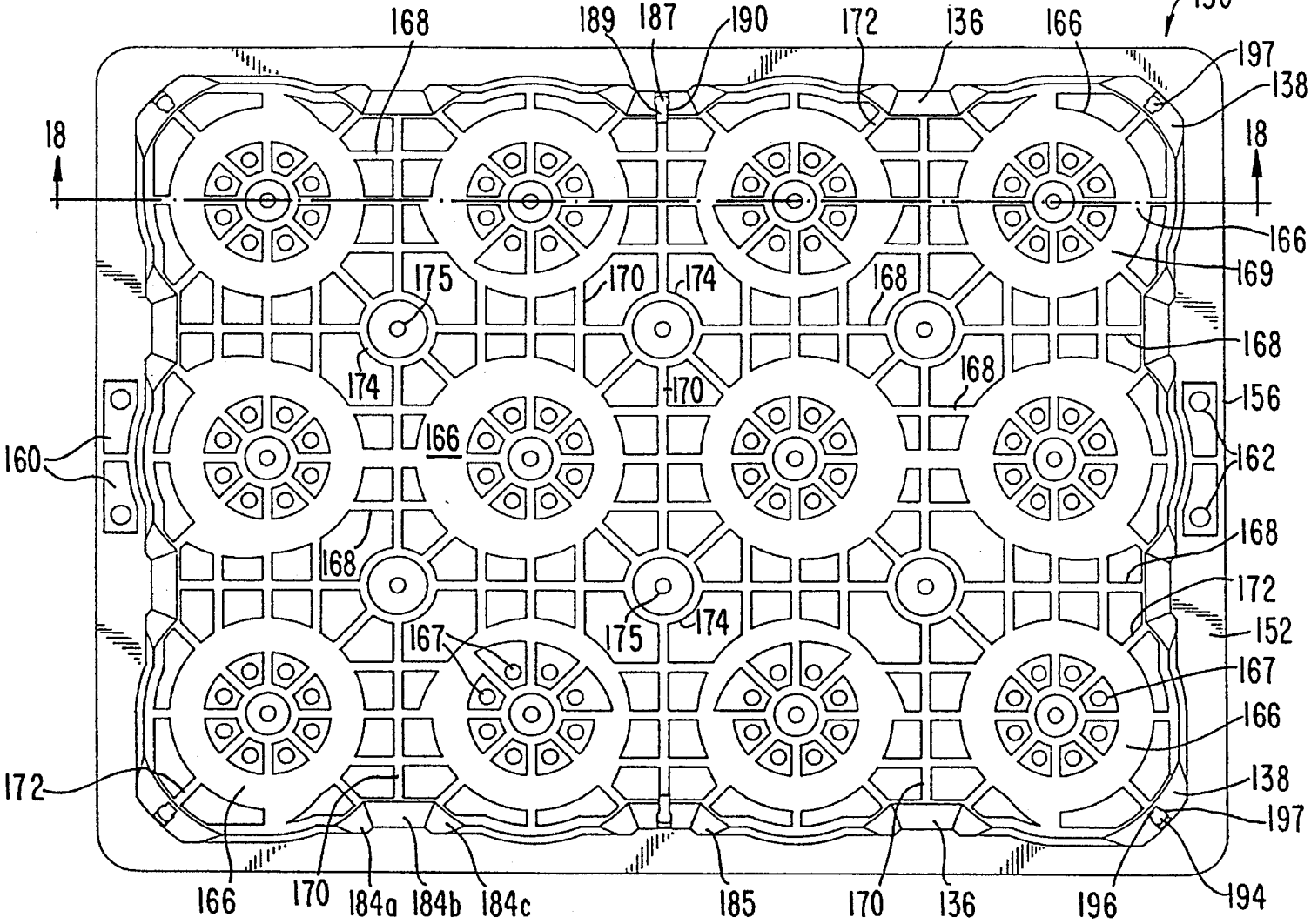
FIG. 12 is a top plan view of the tray of FIG. 10.
Figure 13:
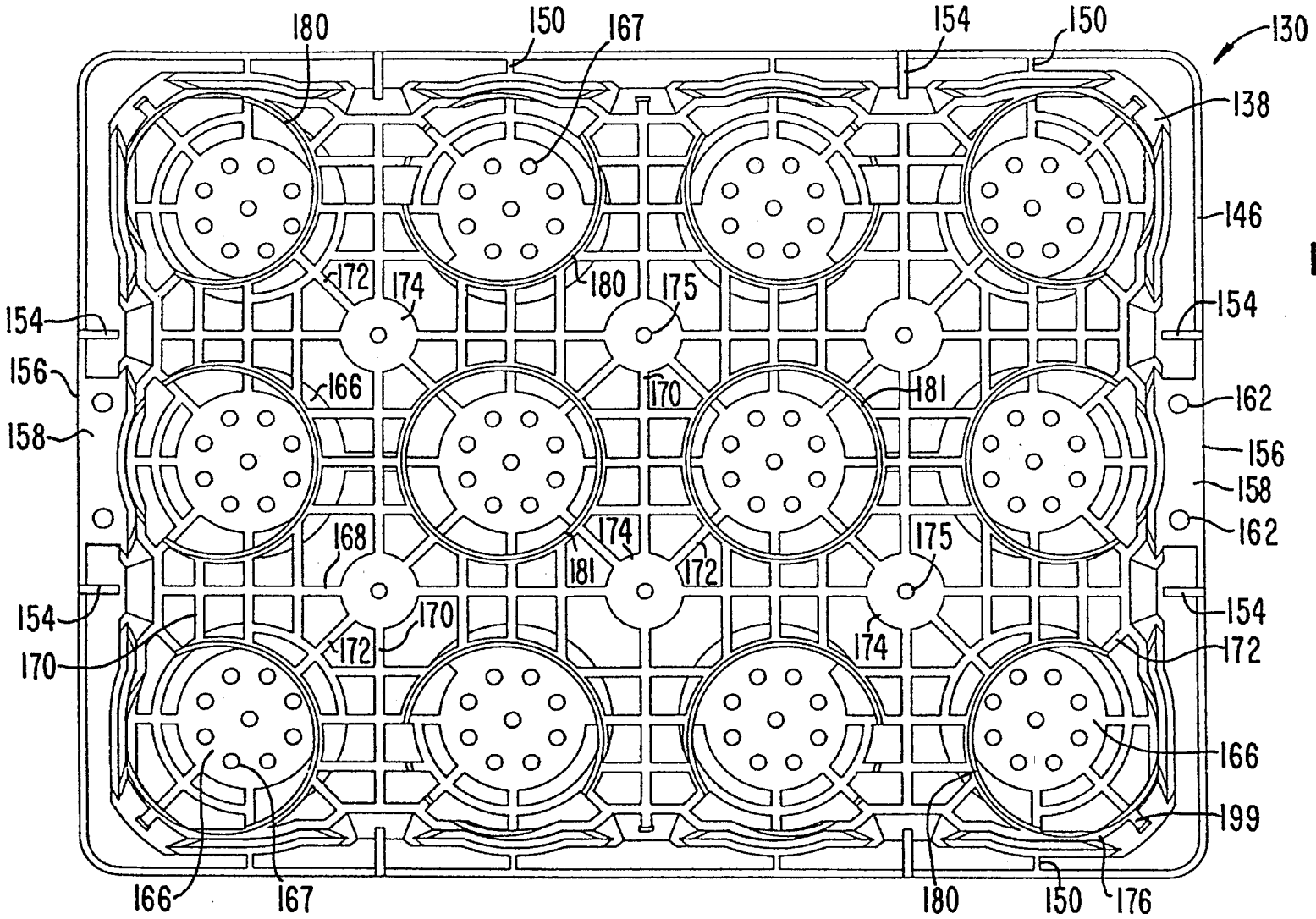
FIG. 13 is a bottom plan view of the tray of FIG. 10.

FIGS. 1–9 illustrate a first preferred embodiment of the present invention. Since many of the advantages of the present invention involve the nestability feature, when referring to nested trays such as shown in FIGS. 7–9, non-primed reference numerals will be used to refer to the tray and primed reference numerals will be used to refer to a similar tray nested beneath the first tray. For example, in FIG. 7, tray 30 is empty and nested into tray 30' which is beneath tray 30. For ease of explanation, the features of the trays are referred to using the same reference numerals distinguished by a prime if referring to a similar tray nested therebeneath.

Referring to FIGS. 1–6, the tray 30 comprises three basic elements, a band 32, a floor 34 and a plurality of columns 36. The wall structure that defines the periphery of tray 30 comprises band 32, which is generally vertical and above floor 34, and is spaced above and connected to floor 34 by a plurality of columns 36. Columns 36 are arranged along the sides of tray 30. Tray 30 may have corner posts 38 at each of the corners of the wall structure. The wall structure preferably includes sidewalls 40 which are longer than endwalls 42, although the wall structure may be a square with walls of equal length.

Band 32 extends around the periphery of tray 30, and is preferably of double wall construction comprising an interior wall 44 and an exterior wall 46. An additional feature of the present invention is the provision of a flat exterior band portion 47 formed as part of exterior wall 46 for stamping, printing or engraving logos or advertisements or other printed matter. Band portion 47 is preferably centered on each of the sidewalls 40, but could be placed anywhere on the band. The portions of interior wall 44 between columns 36 have gently curved indentations 48. Interior wall 44 and exterior wall 46 are connected to one another by a series of bridging struts 50, and preferably a bridging surface 52 connecting the tops of both walls 44, 46 to provide a smooth top surface for tray 30.

A number of bridging struts 50 preferably include beveled strut extensions 54 which are shaped downwardly and inwardly toward a column to act as anti-shingling extensions. When two trays are placed side by side, the bottom of the band of one of the trays could catch or snag onto the top of the band of the adjacent tray, thereby "shingling" onto one another. When more empty trays are subsequently nested into the "shingled" trays, they become unstable and liable to fall. The provision of anti-shingling extensions at locations around the outside, lower edge of the band form a cam-like surface such that the band of a tray would be prevented from resting on the band of an adjacent tray since the extensions of the first tray would tend to ride down the band of the adjacent tray.

The double wall construction of band 32 also affords another advantageous structural feature, handles 56, preferably located on endwalls 42. Handles 56 are formed by providing a bottom bridging surface 58 joining interior wall 44 and exterior wall 46 at the handle location. The tops of handles 56 include drain holes 60 and bottom bridging surfaces 58 also include drain holes 62. When tray 30 is grasped at handles 56, bottom bridging surfaces 58 provide comfortable, smooth resting surfaces for the hands of the user.

Floor 34 preferably has a lattice-like configuration having a pattern of open spaces as shown in FIGS. 1–4. The open floor design provides a light weight tray, and is practical for allowing any liquids to drain through floor 34. The floor is generally flat and open so as not to interfere with secondary wraps or binding means around the containers such as plastic wrap. Referring to FIGS. 1–4, floor 34 has an upper or top surface 64 which is generally flat and includes a plurality of preferably circular support areas or rings 66 for supporting containers thereon. Support areas 66 are connected to each other by a system of grid-like longitudinal struts 68 and lateral struts 70 traversing floor 34 in perpendicular relation to one another, and diagonal struts 72 extending preferably radially from circular support areas 66. Lattice members 74 are preferably circular elements located between support areas 66. Perpendicular struts 68 and 70 extend the full length and width of floor 34, and between the rows and columns of support areas 66. Some perpendicular struts 68 and 70 are joined radially to circular lattice members 74, which in turn are joined to diagonal struts 72, also radially. The open lattice-work floor is made up of support areas 66, perpendicular struts 68 and 70, diagonal struts 72 and lattice members 74. Lattice members 74 are preferably shallow cylindrical members having a closed top surface **74*a* and an open bottom surface 74*b***.

Support areas 66 are arranged in rows and columns to thereby define one or more arrays. In the preferred embodiment, a single three-by-four array accommodates twelve one-liter bottles. Support areas 66 are configured so that an array of bottles are retained in relatively close relation so as to prevent jostling of the bottles during handling. Excess movement of the bottles is to be avoided in order to ensure that the bottles remain in a vertically upright position to most advantageously bear the compressive load of bottles stacked or cross-stacked thereabove minimizing the possibility of the bottles buckling or failing due to a non-axial load.

Each support area or ring 66 is sized to seat bottles and is connected to the other support areas by perpendicular struts 68, 70 and diagonal struts 72. Support rings 66 are preferably solid, generally flat surfaces. Therefore, regardless of the bottom configuration of the bottles, capped or petaloid, the bottles will be easily seated in support areas 66. Floor 34 of the first preferred embodiment of tray 30 also includes floor extensions 65 between columns 36 and extending slightly upwardly from floor top surface 64 to provide enhanced strength and rigidity.

Floor 34 has a bottom surface 76 which has distinctive structural features. Floor bottom surface 76 is configured to allow for stacking and cross-stacking of loaded trays. Cross-stacking is done by rotating a top tray 90 degrees about a vertical axis and lowering onto a bottom tray or trays. During shipping and handling trays may be moved by machines and it is advantageous to use trays which can be stacked or cross-stacked. Additionally, when the trays are used to display the containers in a retail setting, the retailer may wish to cross-stack the trays for display or space reasons. Floor bottom surface 76 has structural features which help hold the tray securely on other trays beneath when stacked and cross-stacked. When a tray is loaded and stacked or cross-stacked above a similarly loaded tray, the tops of the bottles in the tray beneath are loosely retained in position by the floor bottom surface of the tray above. The floor bottom surface of the present invention has the necessary features to accommodate the retention of the tops of bottles loaded in a tray beneath.

Floor bottom surface 76 has a plurality of upwardly recessed bottle top receiving areas 78. Recessed receiving areas 78 are defined by arcs 80 which are integrally molded with and form part of floor bottom surface 76. The positions of arcs 80 are determined to provide a range within which the bottle tops in a loaded tray therebeneath may reside and still provide safe stacking and cross-stacking. Receiving areas 78 help retain bottles in vertically upright positions to bear the compressive load of bottles stacked or cross-stacked thereabove. In general, peripheral receiving areas 78, that is, those adjacent to the wall structure are offset from their corresponding support areas 66. Receiving areas 78 Which are centrally located on the floor are less offset from their corresponding support areas 66. Arcs 80 which form the central receiving areas, moreover, are complete circles 81 which retain the tops of bottles in a loaded tray therebeneath.

Columns 36 along walls 40 and 42 of tray 30 which connect floor 34 to band 32 are positioned between adjacent support areas 66 at the outermost edges of floor 34. Since the wall structure is preferably open between columns 36, windows 82 are formed between columns 36 and under band 32. Windows 82 are sized to expose the UPC labels on the bottles loaded in the tray. It is advantageous to be able to have the UPC code scanned without removing the bottles from the tray. The height of columns 36 and the width of band 32 are preferably configured to allow the UPC code on a bottle in the tray to be read through the window 82. The height of columns 36 is also sufficient enough to prevent the containers from tipping when transported and handled, and low enough, however, so that the tops of the containers extend above band 32 and a stack of nested trays take up minimal vertical space. As shown in FIGS. 7–9, each empty tray only adds minimal additional height to a nested stack of trays.

The exterior surfaces of columns 36' include slots 83' which are configured to receive the inwardly disposed surfaces 84 of columns 36 of a tray nested above. Inward surfaces 84 are generally vertical and preferably have three angled faces 84*a*, 84*b*, 84*c* which would mate in the corresponding slot 83' having mating angled surfaces 83*a*', 83*b*' and 83*c*'. Slots 83' receive inward surfaces 84 of columns of another tray to provide a relatively deeply nested arrangement.

Figure 1:
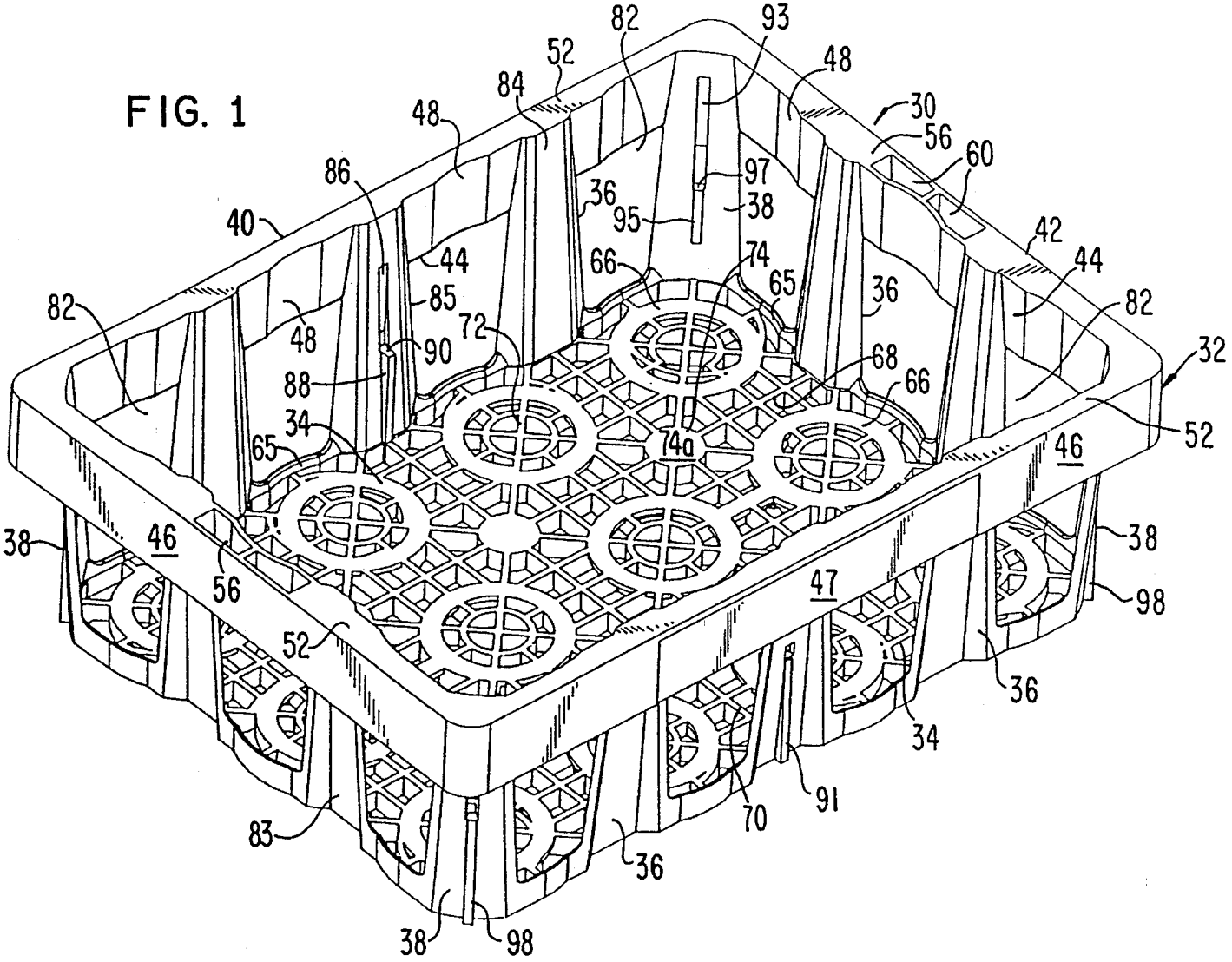
FIG. 1 is a top perspective view of a first preferred embodiment of the tray in accordance with the present invention.
Figure 2:
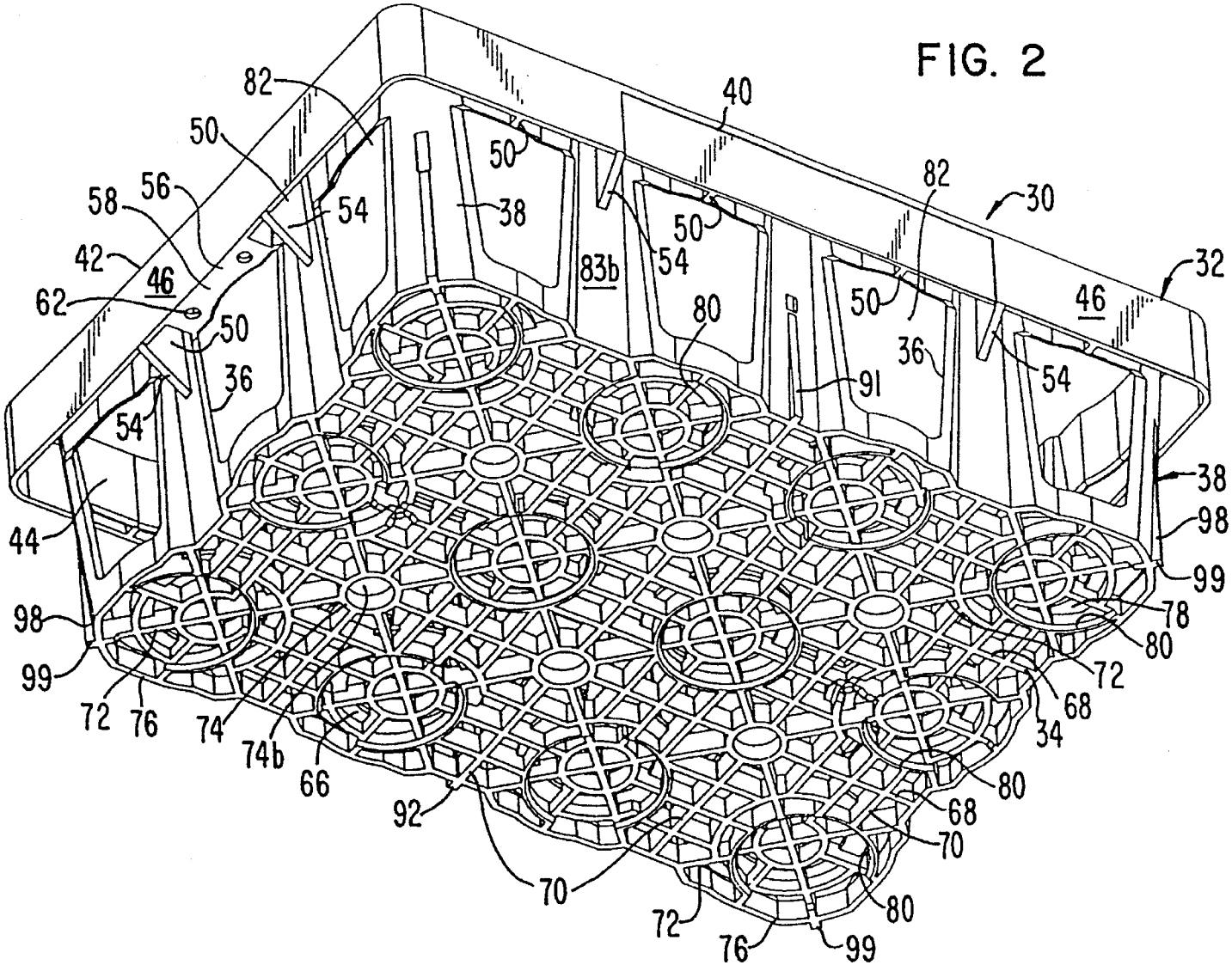
FIG. 2 is a bottom perspective view of the tray of FIG. 1.
Figure 3:
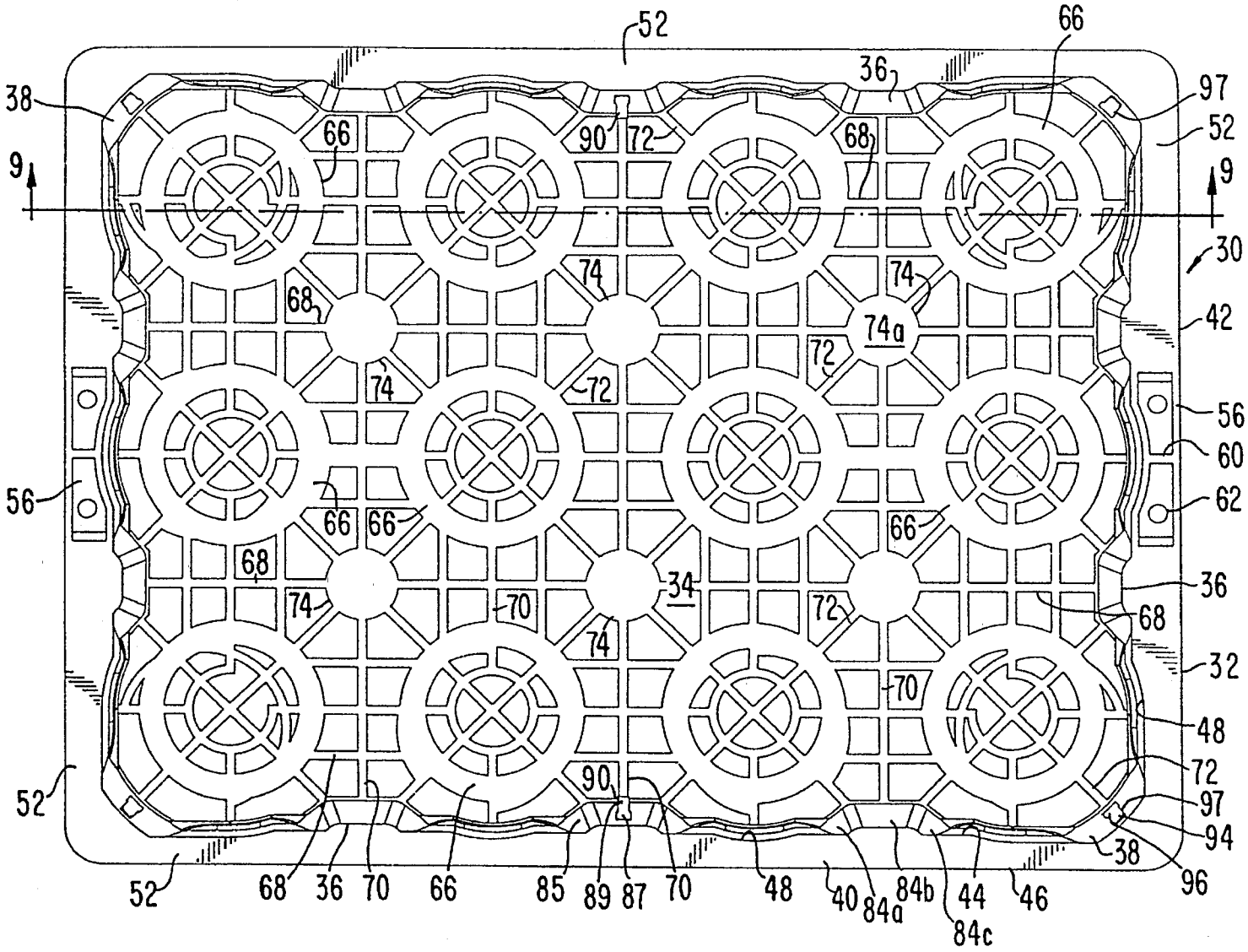
FIG. 3 is a top plan view of the tray of FIG. 1.
Figure 4:
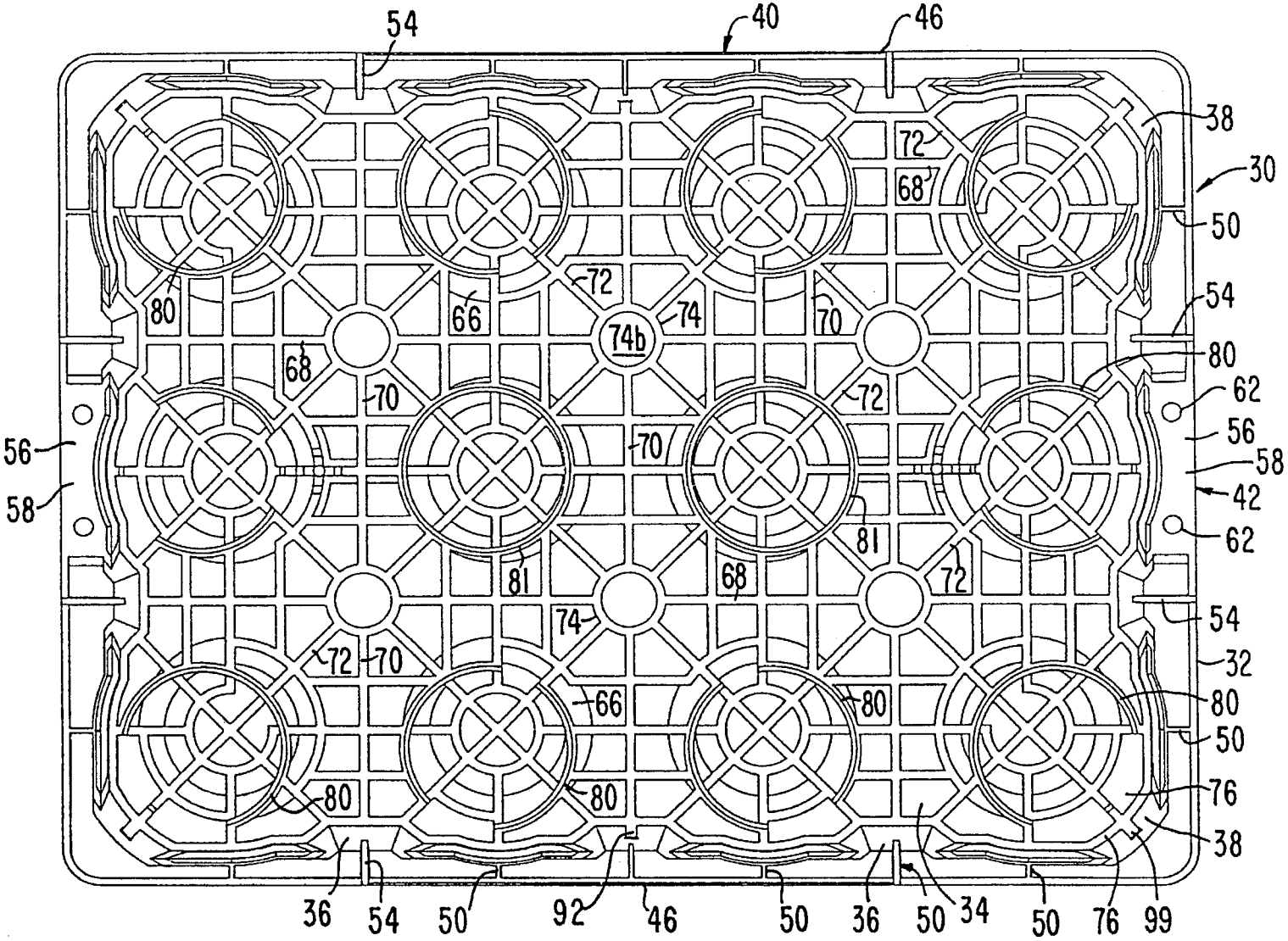
FIG. 4 is a bottom plan view of the tray of FIG. 1.
Figure 5:
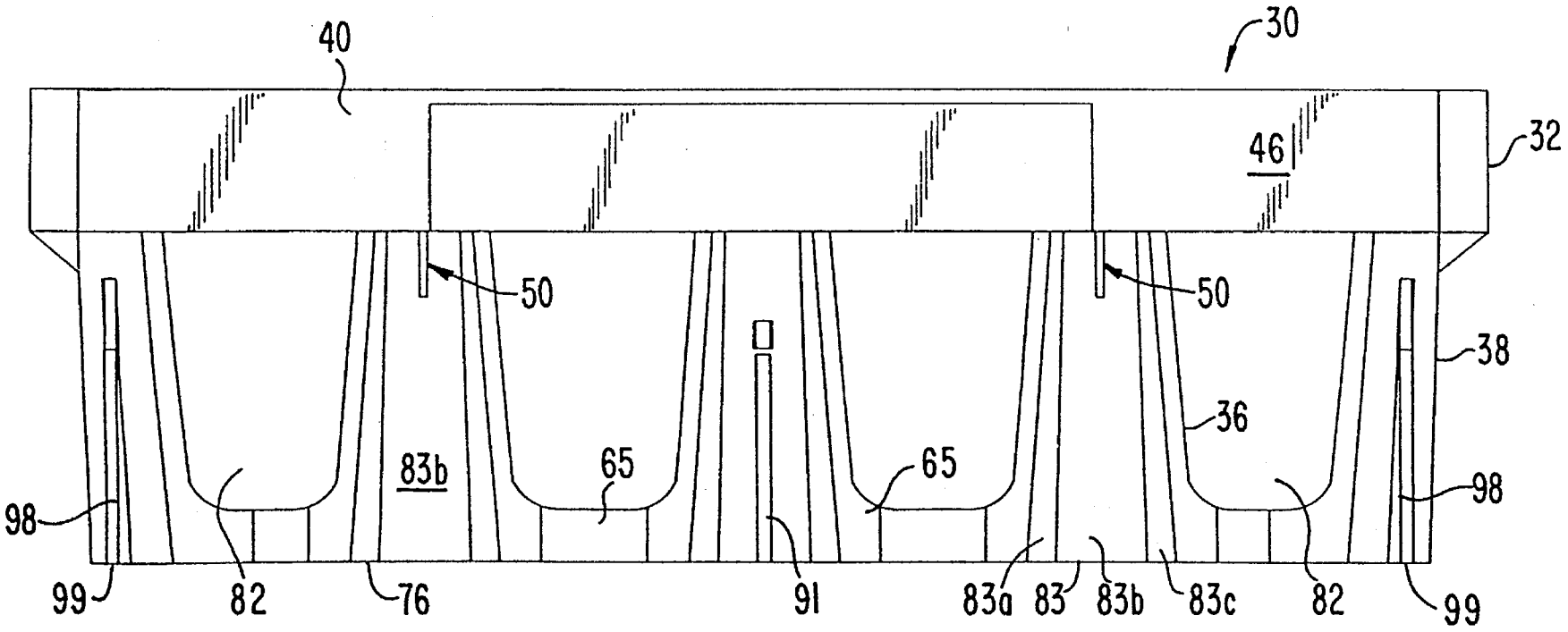
FIG. 5 is a side elevational view of a sidewall of the tray of FIG. 1.
Figure 6:
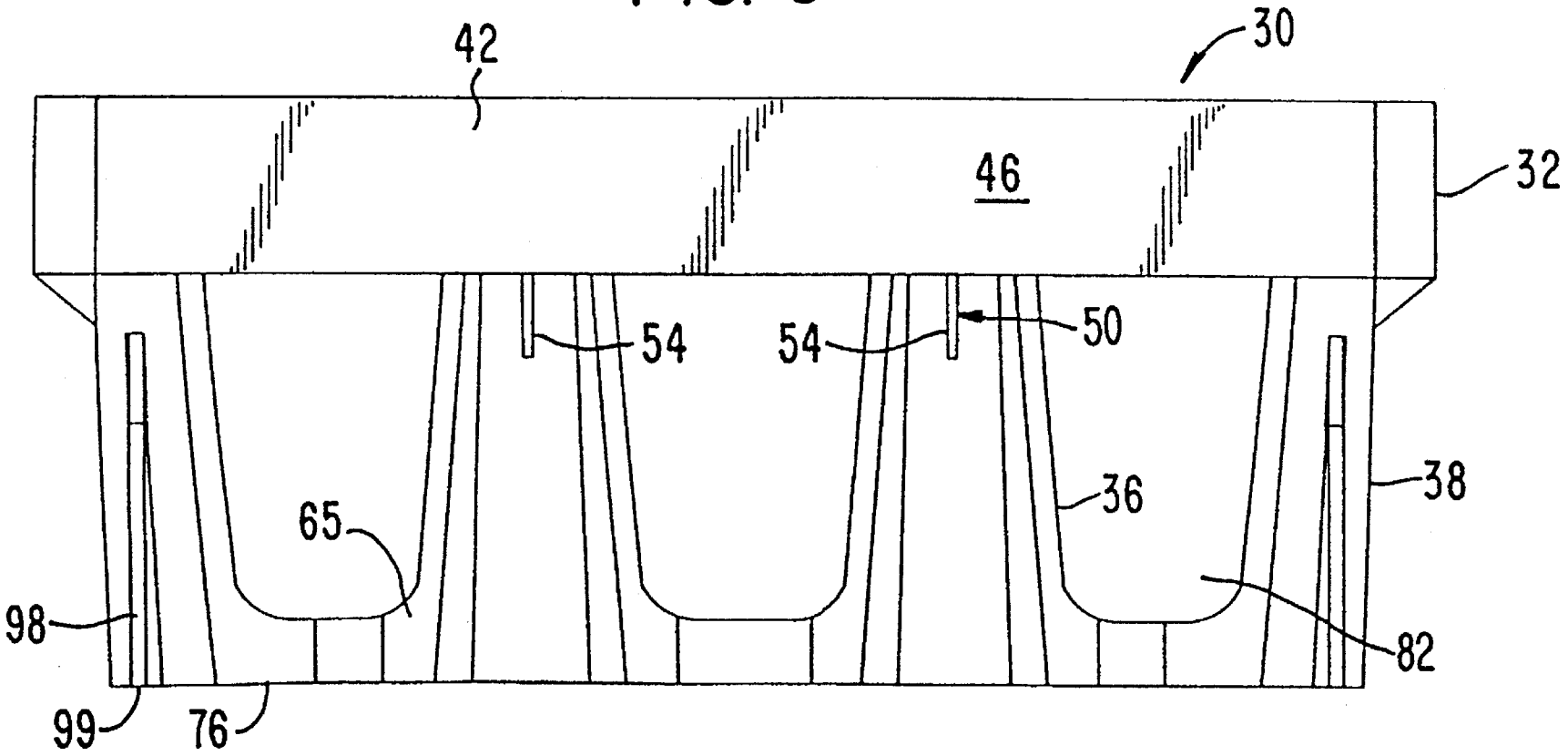
FIG. 6 is an end elevational view of the endwall of the tray of FIG. 1.

Included among columns 36 is at least one ledged column 85, and preferably one along each of side walls 40. As best seen in FIGS. 1 and 3, ledged column 85 has most of the features of the other columns 36. The portion of ledged column 85 directly below band 32 has an indented vertical slot 86, which will be referred to as the vertical wall slot to distinguish from similar slots in the corner posts. Vertical wall slot 86 has a bottom surface 87. Ledged column 85 also includes an interior wall rib 88 extending upward from floor top surface 64 in an inwardly direction. The top surface 89 of the interior wall rib 88 is substantially flush with wall slot bottom surface 87. Together, surfaces 87 and 89 form a wall nesting ledge or shelf 90. Wall nesting ledge 90 is a shelf-like structure in ledged column 85 which also includes an exterior wall rib 91 disposed opposite interior wall rib 88, and extending downward and outward from the ledged column. Bottom surface 92 of exterior wall rib 91 is substantially flush with floor bottom surface 76.

When empty trays are nested, wall slot 86 receives exterior wall rib 91 of another tray nested thereabove so that bottom surface 92 of the exterior wall rib rests on wall nesting ledge 90 in the tray below. In this way, wall nesting ledges 90 support the weight of any trays nested above. Exterior wall ribs 91 reinforce the strength of wall nesting ledges 90.

Since the wall nesting ledges support the weight of above-nested trays, the wall structures of the trays are relieved of that load and consequently are not as prone to splaying outward or fraying. Thus the trays of the present invention maintain their structural integrity and will have a longer service life. Moreover, controlling the spreading or fraying of the wall structures lessens the chances of shingling.

In addition to ledged columns 85, tray 30 of the present invention preferably includes on corner posts 38, structural features for supporting the weight of above-nested trays. Corner post 38 has an indented vertical corner slot 93 directly below band 32. Corner slot 93 has a bottom surface 94, and also includes an interior corner rib 95 extending upward from floor top surface 64 in an inwardly direction. Top surface 96 of the interior corner rib 95 is substantially flush with corner slot bottom surface 94, and together, surfaces 94 and 96 form a corner nesting ledge 97. Corner nesting ledge 97 is similar to wall nesting ledge 90 and also is a shelf-like structure in corner post 38. Comer post 38 also includes an exterior corner rib 98 disposed opposite interior corner rib 95, and extending downward and outward from the corner post. Bottom surface 99 of exterior corner rib 98 is substantially flush with floor bottom surface 76.

When empty trays are nested, corner slot 93' receives the exterior corner rib 98 of another tray nested thereabove so that bottom surface 99 of the exterior corner rib rests on corner nesting ledge 97' of the tray below. In this way, corner nesting ledges 97' support the weight of any trays nested above. Exterior corner ribs 98 reinforce the strength of corner nesting ledges 97.

The corner nesting ledges also support the weight of above-nested trays, so the wall structures of the trays are relieved of that load. Thus as with the wall nesting ledges, the wall structures are not as prone to splaying outward or fraying. The advantages of maintaining structural integrity, longer service life and reduced chances of shingling are gained by use of corner nesting ledges.

The nestability aspect of the present invention is illustrated in FIGS. 7–9 showing trays 30 and 30' nested together. FIGS. 7 and 8 are perspective and side elevational views respectively which illustrate the nesting relationship between the two trays. FIG. 9 shows a cross-section of trays 30 and 30' nested together with tray 30 holding a bottle B only for illustrative purposes. The cross-section is taken along line 9—9 in FIG. 3, and shows in detail the floor of tray 30 resting on nesting ledges 90' and 97' of tray 30'. The weight of empty trays nested above is transmitted vertically downward through nesting ledges and ribs as shown in FIG. 9 to prevent the band or wall structure of the trays from taking the load and thereby fraying or being unduly compressed. The rib and slot structures for nesting empty trays prolong the useful life of the trays and also ensures space-efficient storage of empty trays.

FIGS. 10–18 illustrate the second preferred embodiment of the present invention. For consistency and ease of reference, the tray illustrated in FIGS. 10–18 will be described by using reference numerals which correspond to those used to describe tray 30 of FIGS. 1–9, but in a one-hundred's series. For example, FIGS. 10–18 illustrate tray 130 which has may of the same features of tray 30 shown in FIGS. 1–9. Therefore, a detailed description of tray 130 is provided above with reference to tray 30, and only the differences between the two embodiments will be described in detail. Tray 130 differs from the first embodiment mostly in the configuration of its floor. Floor 134 of tray 130 is generally flat and does not include any extensions around the periphery thereof. Thus windows 182 of tray 130 have sharper, more angular corners than windows 82 of tray 30, which may be a desirable feature.

As best seen in FIGS. 10–13, floor 134 of tray 130 has a floor 134 which preferably has a lattice-like configuration having a pattern of open spaces as shown in FIGS. 10–13. Floor 134 has an upper or top surface 164 which is generally flat and includes a plurality of preferably circular support areas or rings 166 for supporting containers thereon. Support areas 166 are connected to each other by a system of grid-like longitudinal struts 168 and lateral struts 170 traversing floor 134 in perpendicular relation to one another, and diagonal struts 172 extending preferably radially from circular support areas 166. Lattice members 174 are preferably circular elements located between support areas 166. Perpendicular struts 168 and 170 extend the full length and width of floor 134, and between the rows and columns of support areas 166. Some perpendicular struts 168 and 170 are joined radially to circular lattice members 174, which in turn are joined to diagonal struts 172, also radially. Support areas 166 are comprised of a circular member 169 which includes ring 166 and drain holes 167 therein. Drain holes 167 are disposed in spaces surrounded by struts 168, 170 and 172 and are formed through circular member 169. Lattice members 174 are preferably shallow cylindrical members having an open top surface **174*a* and a generally closed bottom surface 174*b*, with the exception of a drain hole 175 preferably in the centers of members 174**.

Since tray 130 is equipped with support areas 166 with more solid elements than the first embodiment, drain holes 167 and 175 allow unwanted liquid to drain out of the bottom of the tray more efficiently. Tray 130 also has a varied appearance than the first embodiment, and the more angular window openings 182 and drain holes 167 and 175 may be desirable visible, as well as structural, features of the invention.

Figure 14:
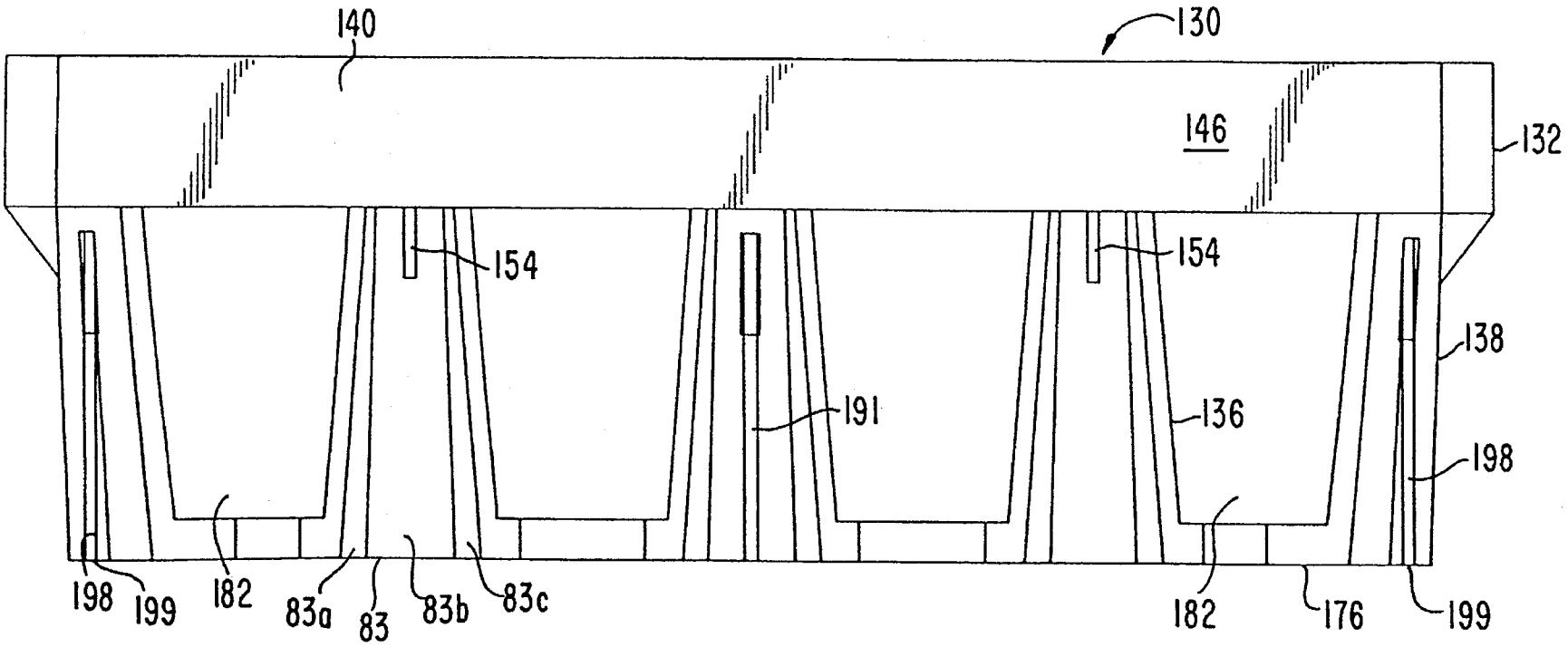
FIG. 14 is a side elevational view of a sidewall of the tray of FIG. 10.
Figure 15:
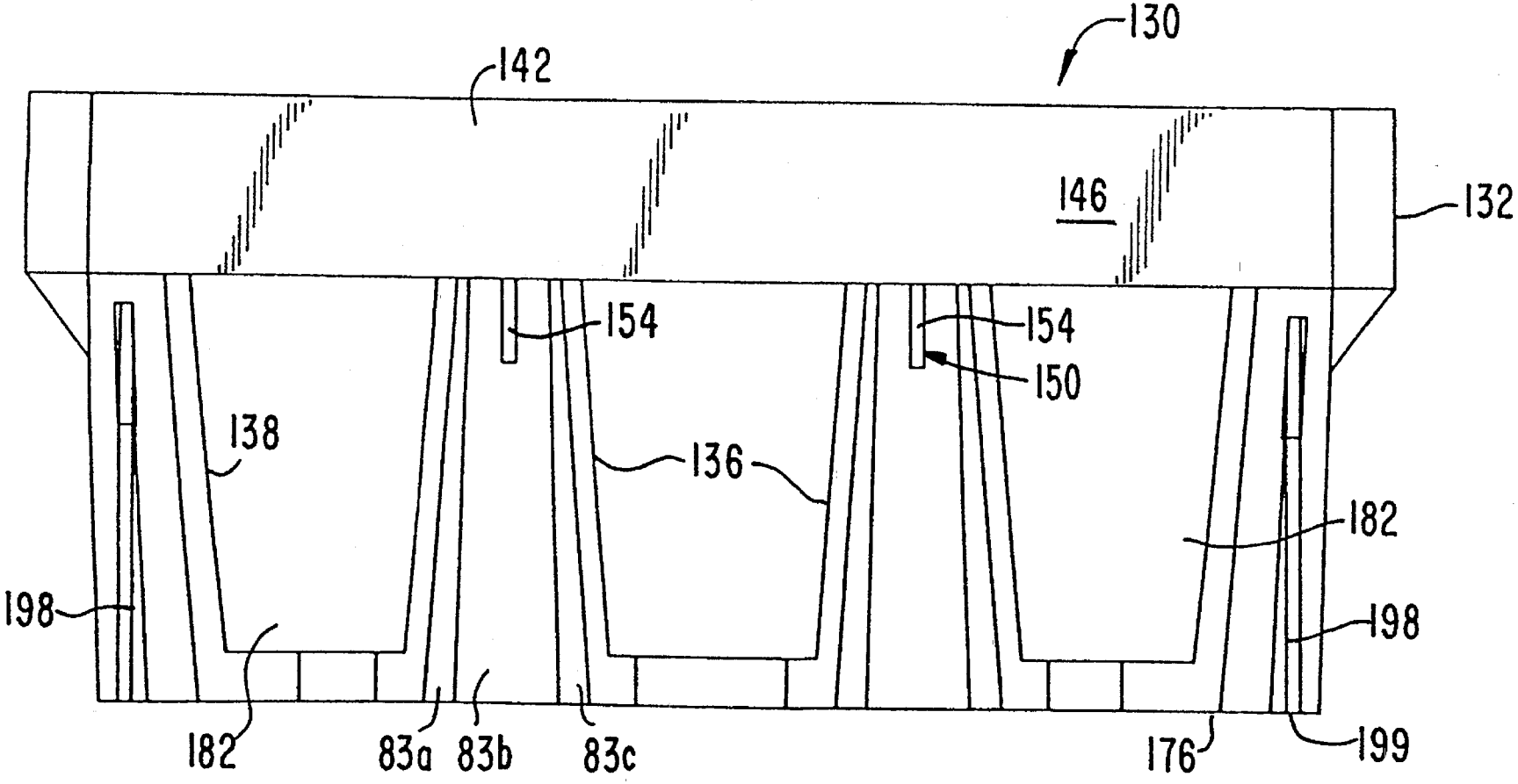
FIG. 15 is an end elevational view of an endwall of the tray of FIG. 10.
Figure 16:
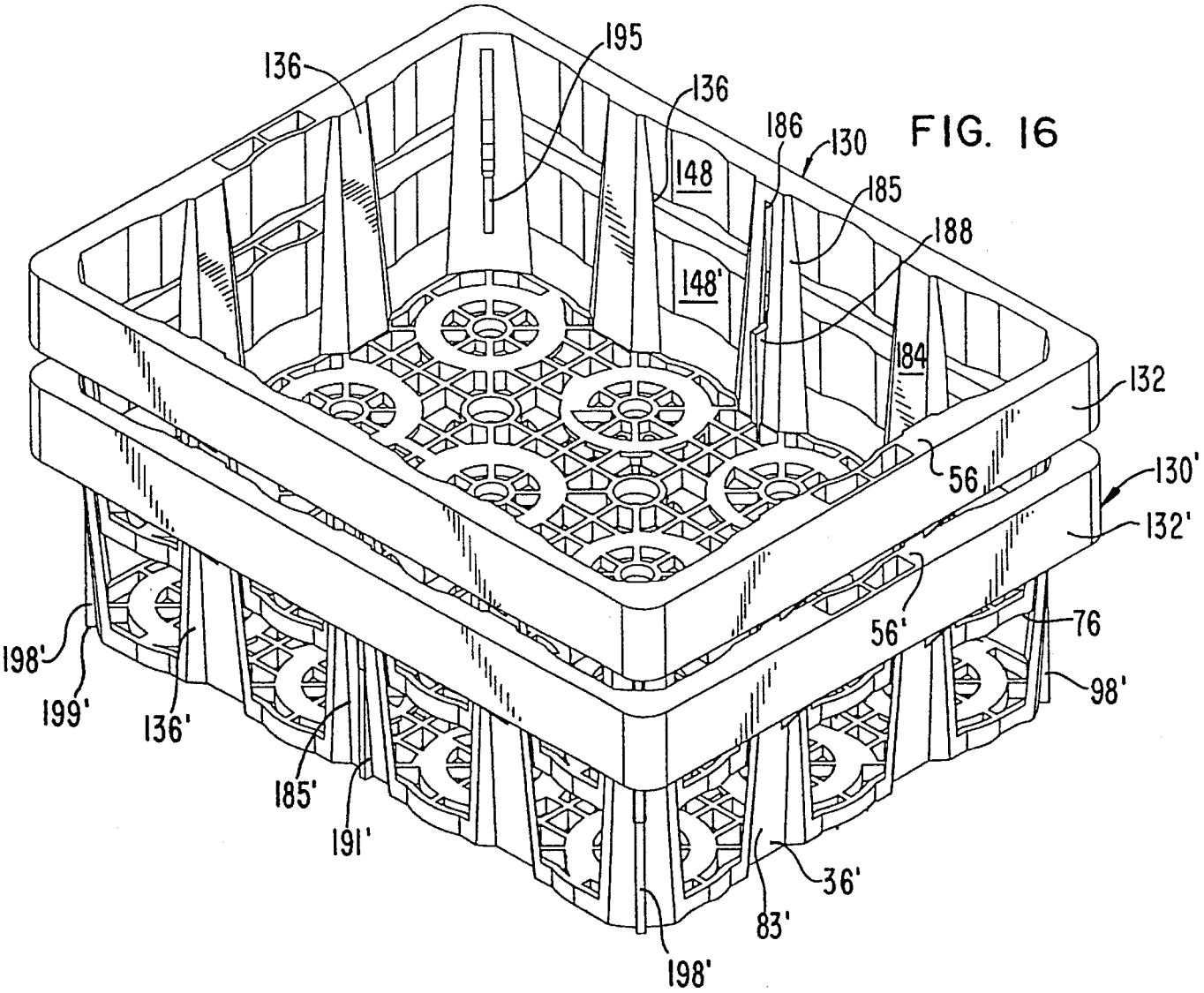
FIG. 16 is a top perspective view of the tray of FIG. 10 nested with an identical empty tray.
Figure 17:
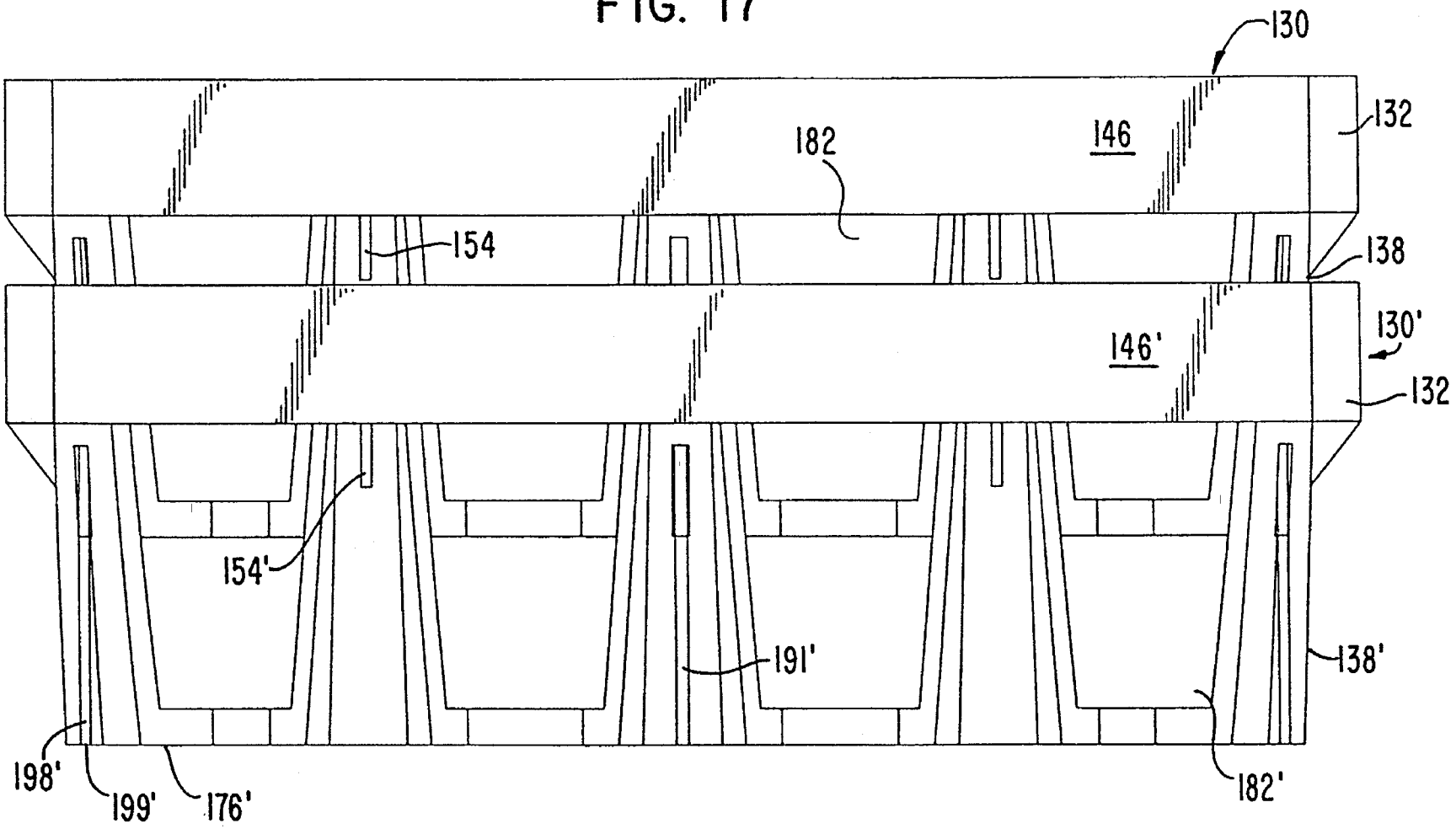
FIG. 17 is a side elevational view of the sidewalls of the nested trays of FIG. 16.
Figure 18:
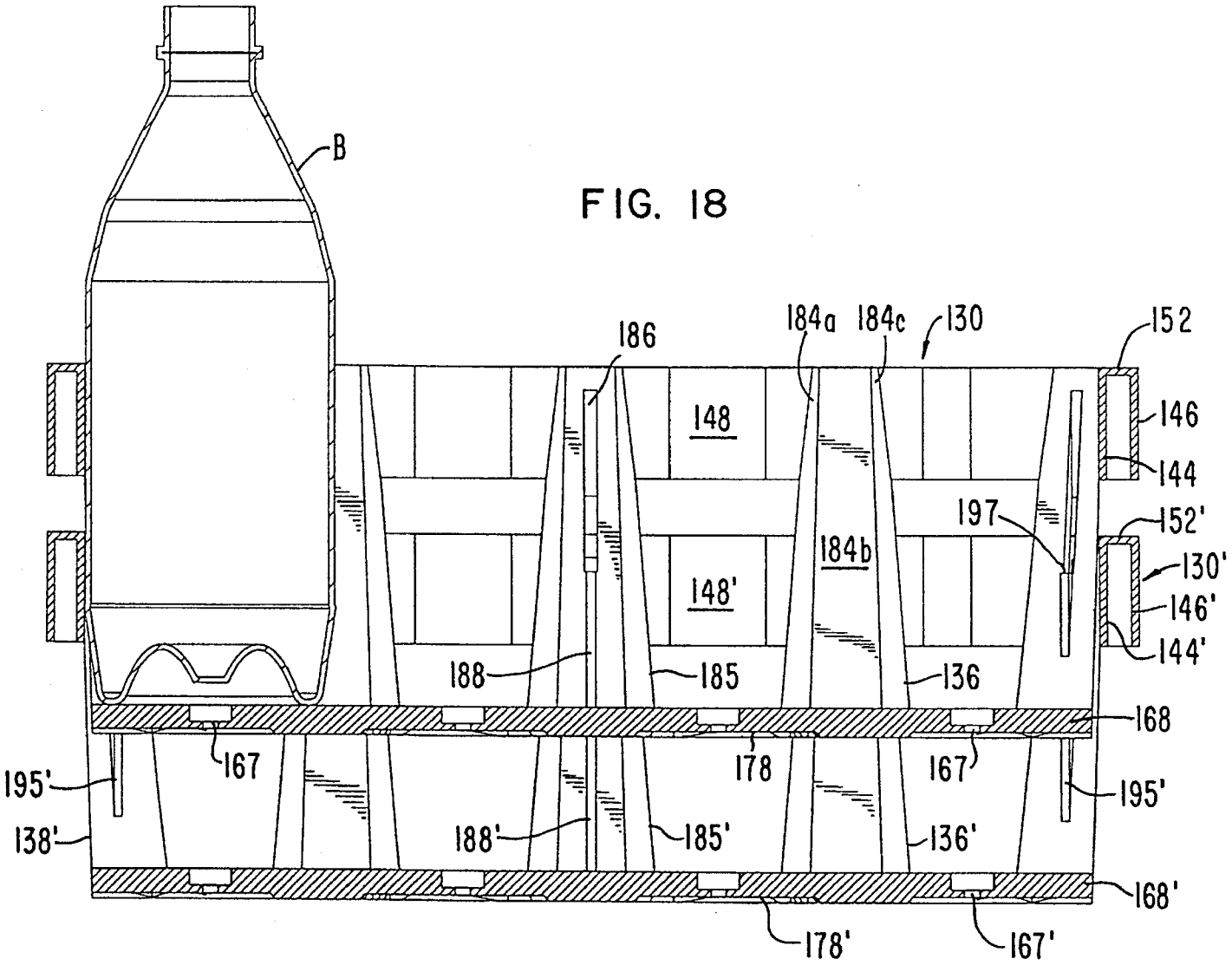
FIG. 18 is a cross-section of the nested trays taken along line 18—18 in FIG. 12 with a bottle on a peripheral receiving area.

Tray 130 is otherwise very similar to tray 30 which is described above, and includes columns 136, ledged columns 185 and corner posts 138. The ledged columns and corner posts include ribs 188, 191, 195 and 198; slots 186 and 193; and nesting ledges 190 and 197 which provide nestability while preventing fraying of the wall structure. Tray 130 has a bottom surface 176 with upwardly recessed bottle top receiving areas 178 for retaining the tops of bottles loaded in the tray. FIGS. 14 and 15, which are the side and end elevational view of tray 130, clearly illustrate the shapes of windows 180. FIGS. 16 and 17 are perspective and side elevational views respectively which illustrate the nesting relationship between tray 130 and a similar tray 130' nested therebeneath. FIG. 18 shows a cross-section of trays 130 and 130' nested together with tray 130 holding a bottle B only for illustrative purposes. The cross-section is taken along line 18—18 in FIG. 12, and shows in detail the floor of tray 130 resting on nesting ledges 190' and 197' of tray 130'.

As with the first embodiment, the weight of empty trays nested above is transmitted vertically downward through nesting ledges and ribs as shown in FIG. 18 to prevent the band or wall structure of the trays from taking the load and thereby fraying or unduly compressed. The rib and slot structures for nesting empty trays prolong the useful life of the trays and also ensures space-efficient storage of empty trays.

Figure 19:
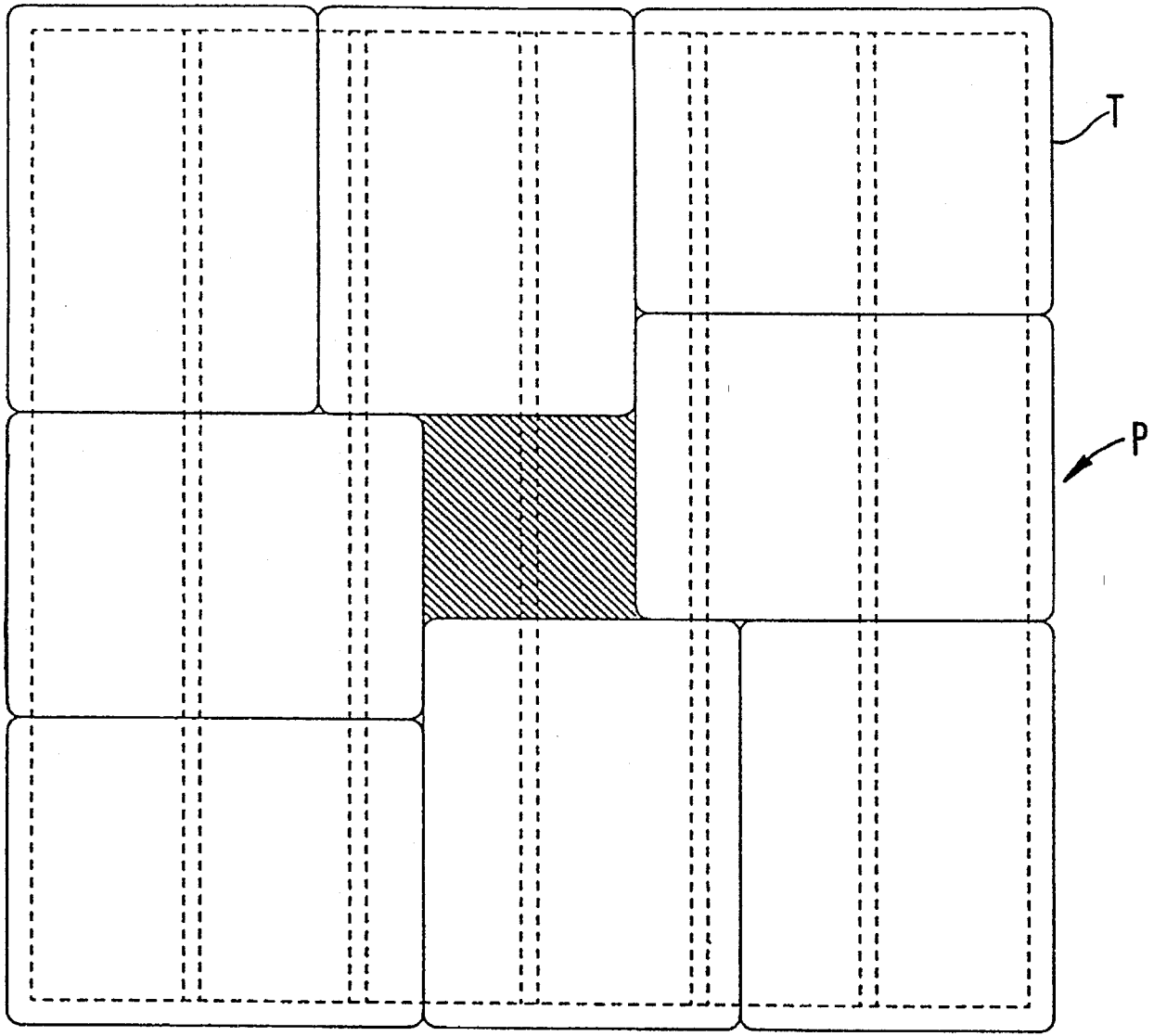
FIG. 19 is a schematic top view of trays arranged on a pallet.

FIG. 19 is a schematic representation of trays T arranged on a pallet P. The particular arrangement of trays T may be varied by cross-stacking the next level of trays such that an overlapping relationship is achieved on the pallet. As will be apparent to one skilled in the art, the shaded area in the center of the pallet will remain the same size and shape even when subsequent layers of trays are cross-stacked. The interlocking arrangement of cross-stacked trays is particularly important to a palletized stack of trays such as schematically shown in FIG. 19. The upwardly recessed bottle top receiving areas of the present invention facilitate forming a stable stack of trays.

The preferred embodiments of the present invention comprise wall nesting ledges and corner nesting ledges, but a tray with only wall nesting ledges to support the weight of nested trays is within the scope of the invention. Any number of columns could be ledged columns, that is, there is no limit to the number of wall nesting ledges which can be provided. Alternatively, a tray with only corner nesting ledges is also within the scope of the invention.

The columns, in addition to their nestability function, must also be substantial enough to support the top band so that the tray does not break apart when the containers push against the band. The columns preferably have a generally pyramidal design allowing them to have the largest area at their bottoms, making it unlikely that they will be torn away from the floor in the event of a severe impact. The columns of the present tray are disposed between the container support areas which are along the periphery of the tray. By this placement of the columns, excessive contact with the containers during normal tray handling, and any resultant damage, is avoided.

In the preferred embodiments of the present invention, the intermediate column is the ledged column, but of course any of the columns may be configured to be ledged columns instead or in addition to the intermediate column.

From the foregoing detailed description, it will be evident that there are a number of changes, adaptations, and modifications of the present invention which come within the province of those skilled in the art. However, it is intended that all such variations not departing from the spirit of the invention be considered as within the scope thereof as limited solely only by the claims appended hereto.

We claim:

1. A low depth nestable tray for an array of generally cylindrical bottles, said tray adapted to be nested with other trays when empty of bottles and stacked with other trays when loaded with bottles, said tray having a low depth wall structure comprising a band extending around the periphery of said tray for preventing the bottles from tipping during transport, said wall structure comprising side walls and end walls, a floor structure having a floor top surface, and a floor bottom surface, a plurality of columns disposed along the wall structure interconnecting the band and the floor structure, the columns configured to not interfere with bottles or multi-packs of bottles loaded in said tray and configured to nest with columns of a similar empty tray, wherein the improvements comprise;

a plurality of support areas on said floor top surface for supporting the bottles in an upright position;

at least two of said columns being ledged columns, each said ledged column comprising an exterior rib extending vertically downward and outward from said ledged column such that the bottom of said exterior rib is substantially flush with said floor bottom surface, an interior rib extending vertically upward and inward from said floor top surface opposite said exterior rib, a vertical slot indented into said ledged column above said interior rib, wherein the top of said interior rib and the bottom of said slot form a nesting ledge and said slot is adapted to matingly receive the exterior rib of another tray nested thereabove so that the bottom of the exterior rib rests on said nesting ledge of said tray when empty and nested with another tray thereabove, wherein the band comprises upright arcuate indentations on its interior surface, said indentations arranged in an alternating manner with the columns and being positioned and configured to correspond to the generally cylindrical peripheral bottles of the array of bottles.

2. The tray of claim 1, wherein the band has a double wall construction and comprises an interior wall and an exterior wall in spaced relation to one another.

3. The tray of claim 2, further comprising bridging struts joining said interior and exterior walls of said band, and wherein said interior wall includes said arcuate indentations.

4. The tray of claim 3, further comprising a substantially smooth bridging surface joining said interior and exterior walls of said double wall, said bridging surface forming the top-most surface of said tray.

5. The tray of claim 4, wherein said bridging struts are disposed between said interior and exterior walls of the band around the periphery of said tray, and said bridging struts are positioned so as to correspond with the locations of the columns and include anti-shingling extensions to prevent the band of said tray from resting on the band of an adjacent similar tray.

6. The tray of claim 1, further comprising upwardly recessed bottle top receiving areas on the floor bottom surface.

7. The tray of claim 1, wherein said tray has corners and each of the columns interconnecting the corner of the wall structure to the floor structure is a corner post, at least one of said corner posts including a corner nesting rib assembly comprising an inwardly projecting, upwardly disposed corner shelf on an inboard surface of said corner post and at a generally central vertical location thereof, and an outwardly projecting, downwardly disposed corner rib on an outboard surface of said corner post at a generally lower location thereof, said corner rib and said corner shelf being positioned and configured relative to one another such that when said tray is nested a distance down into a similar empty tray, said corner rib rests on the corresponding corner shelf of the similar empty tray and when a similar tray is nested down into said tray when empty, the corresponding corner rib of the similar tray rests on said corner shelf.

8. A low-depth nestable bottle tray, comprising:

a tray floor having a floor top surface and a floor bottom surface, said floor top surface including a plurality of support areas for vertically upright supporting in said tray an array of generally cylindrical peripheral bottles, said floor bottom surface including an array of upwardly recessed, bottle top receiving areas for receiving therein the tops of bottles supported in at least one similar bottle tray directly therebeneath and for thereby blocking free sliding movement of said floor bottom surface on the bottle tops;

a generally upright continuous band spaced above said tray floor;

a plurality of angled nesting columns and corner posts interconnecting a periphery of said tray floor with said band; and nesting rib assemblies on at least two of said columns, each said nesting rib assembly including an inwardly projecting, upwardly disposed shelf on an inboard surface of said column and at a generally central vertical location thereof and an outwardly projecting, downwardly disposed rib on an outboard surface of said column at a generally lower location thereof, said rib and said shelf being positioned and configured relative to one another such that when said tray is nested a distance down into a similar empty tray, said rib rests on the corresponding shelf of the similar empty tray and when a similar tray is nested down into said tray when empty, the corresponding rib of the similar tray rests on said shelf, wherein said column and said shelf are dimensioned such that said shelf supports the weight of the tray nested thereabove.

9. The tray of claim 8, wherein said band comprises upright arcuate indentations on its interior surface, said indentations arranged in an alternating manner with said columns and being positioned and configured to correspond to the generally cylindrical peripheral bottles of the array of bottles.

10. The tray of claim 9, wherein said band has a double wall construction comprising an interior wall and an exterior wall band in spaced relation to one another.

11. The tray of claim 10, further comprising handles formed in said band.

12. The tray of claim 10, further comprising bridging struts joining said interior and exterior walls of said band, and wherein said interior wall includes said arcuate indentations.

13. The tray of claim 12, further comprising a substantially smooth bridging surface joining said interior and exterior walls of said double wall, said bridging surface forming the top-most surface of said tray and comprising drain holes where said handles are located.

14. The tray of claim 13, wherein said bridging struts are disposed between said interior and exterior walls of said band around the periphery of said tray, and said bridging struts are positioned so as to correspond with the locations of said columns and include anti-shingling extensions to prevent shingling of the band on said tray onto the band of an adjacent similar tray when the trays are palletized.

15. The tray of claim 8, wherein said bottle top receiving areas on said floor bottom surface comprise at least potions of generally circular rings.

16. The tray of claim 8, further comprising a corner nesting rib assembly on at least one of said corner posts, said corner nesting rib assembly including an inwardly projecting, upwardly disposed corner shelf on an, inboard surface of said corner post and at a generally central vertical location thereof and an outwardly projecting, downwardly disposed corner rib on an outboard surface of said corner post at a generally lower location thereof, said corner rib and said corner shelf being positioned and configured relative to one another such that when said tray is nested a distance down into a similar empty tray, said corner rib rests on the corresponding corner shelf of the similar empty tray and when a similar tray is nested down into said tray when empty, the corresponding corner rib of the similar tray rests on said corner shelf.

17. A low-depth nestable tray for bottles, said tray adapted to be nested with other similar trays when empty of bottles and low-depth stacked with other similar trays when loaded with bottles, said tray comprising:

a low-depth wall structure including a peripheral tray band, said wall structure including side walls and end walls;

a floor having a floor top surface and a floor bottom surface, said floor top surface comprising a plurality of support areas for supporting an array of bottles vertically upright, said floor bottom surface including upwardly recessed bottle top receiving areas for receiving tops of bottles in at least one similar tray therebeneath; and a plurality of columns along said wall structure interconnecting said band and said floor, said columns configured and positioned so as to not interfere with bottles or multi-packs of bottles supported on said floor and to empty nest with similar columns of another similar tray, wherein at least two of said columns are ribbed columns, each said ribbed column comprising:

(a) an exterior rib extending vertically downward and outward such that the bottom of said exterior rib is substantially flush with said floor bottom surface, (b) an interior rib extending vertically upward and inward from said floor top surface opposite said exterior rib, and (c) a vertical slot positioned above said interior rib, wherein the top of said interior rib and the bottom of said slot form a nesting rib and said slot is configured and positioned to matingly receive the exterior rib of another similar tray empty nested thereabove and therewith such that the bottom of the exterior rib rests on said nesting rib of said tray when empty and nested with another tray thereabove.

18. A low depth nestable tray for an array of generally cylindrical peripheral bottles, said tray adapted to be nested with other trays when empty of bottles and stacked with other trays when loaded with bottles, said tray having a low depth wall structure comprising a band extending around the periphery of said tray for preventing the bottles from tipping during transport, said wall structure comprising side walls and end walls, a floor structure having a floor top surface, and a floor bottom surface, a plurality of columns disposed along the wall structure interconnecting the band and the floor structure, the columns configured to nest with columns of a similar empty tray, wherein the improvements comprise;

a plurality of support areas on said floor top surface for supporting the bottles in an upright position;

at least two of said columns being ledged columns, each said ledged column comprising at least one exterior column portion extending vertically downward from said ledged column such that the bottom of said exterior column is substantially flush with said floor bottom surface, at least one interior column portion extending vertically upward from said floor top surface, a vertical receiving portion indented into said ledged column above said interior column portion, wherein the top of said interior column portion and the bottom of said receiving portion form a nesting ledge and said receiving portion is adapted to matingly receive the exterior column portion of another tray nested thereabove, wherein the bottom of the exterior column portion rests on the nesting ledge of a subjacent tray when said tray is empty and nested therewith, and wherein said nesting ledge and said columns are dimensioned such that the nesting ledge supports the weight of said tray thereabove and thereby maintains a spaced distance between the bands of adjacent nested trays.

wherein the band comprises upright arcuate indentations on its interior surface, said indentations arranged in an alternating manner with the columns and being positioned and configured to correspond to the generally cylindrical peripheral bottles of the array of bottles.

* * * * *